US010145193B2

(12) United States Patent
Watson et al.

(10) Patent No.: US 10,145,193 B2
(45) **Date of Patent: *Dec. 4, 2018**

(54) AXIALLY SEPARATING DRILL BUCKET

(71) Applicants: Richard W. Watson, Lakeside, CA (US); Stanley J. Anderson, Lakeside, CA (US)

(72) Inventors: Richard W. Watson, Lakeside, CA (US); Stanley J. Anderson, Lakeside, CA (US)

(73) Assignee: Spinoff Drilling Buckets, Lakeside, CA (US)

( * ) Notice: Subject to any disclaimer, the term of this patent is extended or adjusted under 35 U.S.C. 154(b) by 261 days.

This patent is subject to a terminal disclaimer.

(21) Appl. No.: 15/095,085

(22) Filed: Apr. 10, 2016

(65) Prior Publication Data

US 2016/0251899 A1 Sep. 1, 2016

Related U.S. Application Data

(63) Continuation-in-part of application No. 13/845,556, filed on Mar. 18, 2013, now Pat. No. 9,309,736.

(51) Int. Cl.

| | |
|---|---|
| ***E21B 7/00*** | (2006.01) |
| ***E21B 27/00*** | (2006.01) |
| ***E21B 10/32*** | (2006.01) |

(52) U.S. Cl.

CPC ..... *E21B 27/00* (2013.01); *E21B 7/003* (2013.01); *E21B 10/325* (2013.01)

(58) Field of Classification Search

CPC ..... E21B 27/00; E21B 27/04; E21B 7/003; E21B 10/325

See application file for complete search history.

(56) References Cited

U.S. PATENT DOCUMENTS

| | | | | |
|---|---|---|---|---|
| 1,442,984 A * | 1/1923 | Smith | E21B 7/003 | 175/316 |
| 2,873,950 A * | 2/1959 | Kandle | E21B 4/18 | 173/141 |
| 2,997,797 A * | 8/1961 | Frankum, III | E21B 27/00 | 175/203 |
| 6,533,048 B2 * | 3/2003 | Groce, Jr. | E21B 7/003 | 175/316 |
| 6,655,476 B2 * | 12/2003 | Groce, Jr. | E21B 7/003 | 175/316 |
| 8,615,906 B2 * | 12/2013 | Matthias | E21B 27/00 | 175/316 |

* cited by examiner

*Primary Examiner* — Nicole Coy

(74) *Attorney, Agent, or Firm* — Richard D. Clarke

(57) ABSTRACT

There is provided an Axially separating drill bucket for drilling large holes in the earth by which a drilling operator can perform the drilling operation with the Axially Separating Drill Bucket, incorporating a spring loaded latching mechanism and a hydraulic cylinder within a drill head casing, and remove the excavated material in one operation. The unit can be raised to the surface where the bucket portion is moved up or down from the drill head to empty the excavated material. A spring loaded latching mechanism is disclosed having a pushrod which activates the latch by making contact with an external force. A centrally located hydraulic cylinder power assists the drill head to be raised and lowered to remove the material collected within the drill bucket.

20 Claims, 15 Drawing Sheets

AXIALLY SEPARATING DRILL BUCKET

FIELD OF THE INVENTION

This application relates to the field of equipment used in drilling large foundation holes for buildings and bridges and more specifically to a unique telescopic drilling bucket mechanism. The current invention provides a drilling bucket assembly along with a unique drill head apparatus that improves the operation by which a drilling operator can remove dirt from a drilling device. With the combination of a drilling head and bucket, the unit can be raised to the surface where the bucket portion is moved up or down from the drill head to empty the excavated material.

BACKGROUND OF THE INVENTION

Foundation chilling has evolved over time and continues to be an essential operation for all construction of bridges, buildings and skyscrapers. Without proper holes for the drilled foundation piles, a budding or bridge could be destroyed in the event of an earthquake. In an effort to improve the production and quality of drilled foundations, there has been a sizable investment, and significant advancement, in the equipment and tools of the trade.

Some of the most common tools used by foundation drillers are the separate digging, and cleanout buckets. Digging buckets are used to dig through hard layers of dirt and rock and are known for their ability to keep holes true and straight as possible. Drilling buckets are often used to manage water in the hole when drilling fluid is necessary to keep the holes from caving in. Axially separating drill buckets keep the drill fluids clean by containing the loose soils and preventing them from mixing with or contaminating drill fluids. Augers are used for digging large holes but have no efficient means of moving the material to the surface. Cleanout buckets are used to clean the bottom of the holes during the digging process to remove any loose rocks and soil to ensure a clean solid bottom surface for a foundation.

In executing pile foundations in construction work, a unique method of drilling earth is proposed in this application. In this method a rotatable bucket is used for excavating a straight pile bore and also moving the excavated soil from the bore hole to the surface. The Axially separating drill bucket assembly is attached to the lowermost position of a Kelly bar, a conventional part of the drilling rig, and suspended to perform the drilling operation. When the bucket is rotated, the soil excavated by a unique drill head is moved into the drill bucket. The drill bucket filled with the excavated soil is then raised by the drilling rig and the soil in the bucket is removed when an actuator member comes in contact with the stationary sombrero, a conventional part of the drilling rig, and the drill bucket is either raised above the drill head or the drill head pushed down from the drill bucket. Several methods can be used to accomplish this similar process, some being a scissor action mechanical method, a hydraulic actuated method, a direct downward pressure method and a method where a latch is actuated by a rod coming against the sombrero to release the drill head to translate down a telescoping shaft to remove the material by the means of rapidly spinning the device.

Numerous innovations for drills used for drilling foundation piles have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Axially separating drill bucket and the prior art.

U.S. Pat. No. 5,234,062 of Hachiro Inoue describes an automatic evacuation drilling bucket comprising a follower formed with a working space for receiving a blade member which is capable of coming in contact with an osculating arm, the working space having upper, lower, transition and receiving compartments. If the blade member is located in the upper and lower compartments, the blade member is engaged with the follower when a drive shaft member is rotated in the normal and reverse directions. If the blade member is urged to move into the receiving compartment through the transition compartment, the blade member comes in contact with the osculating arm when the drive shaft member is rotated in the reverse direction.

This patent describes an automatic evacuation drilling bucket that operates with a fixed drill bucket that has a hinged member at the bottom for the removal of the excavated material. If the material sticks to the side of the drill bucket it must be jarred to remove it and that often damages the equipment involved. It does not have the capability of digging the hole, cleaning the hole out, moving the material to the surface, separating the drill bucket from the drill head and pushing the material out in one operation.

U.S. Pat. No. 4,971,163 of Akira Ohashi et al. describes a drilling bucket apparatus for expanding a bore-hole bottom for a cast-in-place pile. Drill bits are pivotally suspended from the upper portion of a drill pipe, which is a main frame of the apparatus, and are expanded and retracted radially by means of hydraulic cylinders. A bucket is attached to the lower end of the drill pipe and scrapers are installed on the side of the bucket. The scrapers are arranged to open and close sideward, following the movement of the drill bits. During drilling work, the apparatus is suspended from a Kelly bar of a drilling machine. When the apparatus is rotated and the drill bits are expanded, the whole expanded shape of a bore-hole bottom is drilled simultaneously and cuttings are scraped into the bucket by means of the drill bits and the scrapers. Further, a bottom lid of the bucket can be released by operating a hydraulically-actuated opening lever, whereby, cuttings are discharged automatically.

This patent describes a drilling bucket apparatus for expanding a bore-hole bottom for a cast-in-place pile. It does not have the capability of digging the hole, cleaning the hole out, moving the material to the surface, separating the drill bucket from the drill head and pushing, the material out in one operation.

U.S. Pat. No. 4,604,818 of Hachiro Inoue describes an under reaming pile bore excavating bucket and the method of excavating an under reamed part of a pile bore, and more particularly to an excavating bucket such that an under reamed part of a pile bore can be excavated and further the excavated soil can be moved into the bucket body for easy removal of soil. The bucket includes, in particular, a plurality of slidable wing bits housed within a bucket and moved downward and extended outward along guide rails at the bottom of an already excavated straight pile bore.

This patent describes an under reaming pile bore excavating bucket and the method of excavating an under reamed part of a pile bore. The bucket includes, in particular, a plurality of slidable wing hits housed within a bucket and moved downward and extended outward along guide rails at the bottom of an already excavated straight pile bore. It does not have the capability of digging the hole, cleaning the hole out, moving the material to the surface, separating the drill bucket from the drill head and pushing the material out in one operation.

U.S. Pat. No. 2,126,124 of Frank S. McCutcheon describes an excavating bucket that may be used for circular shafts and wells, and that may be completely operated and controlled with only one cable. A further object of my invention is to provide an excavating bucket to be used in confined quarters where the space of operation is limited. Still further objects of this invention are to provide an excavating bucket that is positive in its action, which conforms to the shape of the excavation, that allows water to run from the excavated material in the bucket and that has few moving parts. A still further object of my invention is to provide an excavating bucket that is economical in manufacture, durable and efficient in use.

This patent describes an excavating bucket that may be used for circular shafts and wells. It does not have the capability of digging the hole, cleaning the hole out, moving the material to the surface, separating the drill bucket from the drill head and pushing the material out in one operation.

Patent Application Publication No. US 2004/0168831 A1 of Satoshi Nozaki et al. describes locking elements that are provided at an inner member connected to a Kelly bar, and a locking element bearing plate provided at an outer member. The outer member includes a cylindrical bucket and a grab bucket housed inside the cylindrical bucket. When an excavating tool is in its most contracted state, the inner member is rotated forward to lock the locking elements at the locking element bearing plate, thereby disallowing relative vertical movement of the inner member and the outer member. As the excavating tool is rotated by applying a force to the Kelly bar along the lifting direction in this state, an excavating operation can be executed while applying a load smaller than the load of the excavating tool. As a result, it becomes possible to execute an excavating operation with a large excavating tool in conjunction with an earth drill having a small drive force. Projections provided at the outer circumference of the inner member are fitted at guide rails extending along the longitudinal direction and provided at the inner circumference of the second member so as to be allowed to move up/down freely. Thus, the grab bucket having an underground obstacle grabbed therein can be rotated to remove the underground obstacle.

This patent describes a device where the outer member includes a cylindrical bucket and a grab bucket housed inside the cylindrical bucket. When an excavating tool is in its most contracted state, the inner member is rotated forward to lock the locking elements at the locking element bearing plate, thereby disallowing relative vertical movement of the inner member and the outer member. It does not have the capability of digging the hole, cleaning the hole out, moving the material to the surface, separating the drill bucket from the drill head and pushing the material out in one operation.

None of these previous efforts, however, provides the benefits attendant with the Axially separating drill bucket. The present design achieves its intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of this application in detail it is to be understood that the design is not limited in its application to the details of construction and to the arrangement of the components set forth in the following description or illustrated in the drawings. The Axially separating drill bucket is capable of other embodiments and of being practiced and carried out in various ways. In addition, it is to be understood that the phraseology and terminology employed herein are for the purpose of description and should not be regarded as limiting.

SUMMARY OF THE INVENTION

The principal advantage of the Axially separating drill bucket is that it eliminates the stress and shock loads incurred on the machinery's hydraulic equipment when attempting to remove material from existing drill buckets.

Another advantage of the Axially separating drill bucket is that it both drills the hole and removes the material in a single operation.

Another advantage of the Axially separating drill bucket is that in different designs the bucket can be raised above the drill head or the drill head can be lowered below the bucket to remove the excavated material.

Another advantage is Axially separating drill buckets keep the drill fluids clean by containing the loose soils and preventing them from mixing with or contaminating drill fluids.

Another advantage of the Axially separating drill bucket is that the unique drill head has the capability to be rotated in one direction to drill the hole with the material entering the drill bucket and rotating in the opposite direction to close off the opening to the internal cavity to retain the material to be lifted to the surface.

Another advantage of the Axially separating drill bucket is that several methods can be used to either raise the bucket or lower the drill head.

Another advantage of the Axially separating drill bucket is that when lifted above the surface an actuator member can come in contact with the sombrero of the drill rig to activate the release mechanism.

Another advantage of the Axially separating drill bucket is the material does not rely on gravity to fall out of the bucket.

Another advantage of the Axially separating drill bucket is the material can be pushed out and spread out evenly by the accelerated spinning motion.

Another advantage of the Axially separating drill bucket is the material cannot stick in the bucket.

Another advantage of the Axially separating drill bucket is if water is in the hole when drilling, there is an internal cavity to allow the water to pass through the Drill Bucket.

Another advantage is the time saved by only using a single operation rather than lowering a drill unit and an excavating unit separately.

Another advantage is to provide an Axially separating drill bucket assembly that reduces costly repairs.

Another advantage is to provide a simple device with few moving parts.

Another advantage is to provide spring loaded latching mechanism to release and re-latch the drill head from the drill bucket.

Another advantage is having the angled section on the spring loaded push rod to activate the spring loaded latching mechanism.

Another advantage is having the spring loaded push rod pressed down by the sombrero against the pusher plate to move the material within the drill bucket out.

Another advantage is having the telescoping capability between the outer tubular telescoping drill stem with a latching catch and the inner tubular drill stem.

Another advantage is using square heavy all tubing for the outer tubular telescoping dull stem and the inner tubular drill stem to minimize the torsional stresses on the drill stem when the Axially separating drill bucket is rotated.

Another advantage is using a sealed hydraulic or pneumatic cylinder with a limited bypass within the square drill stem to cushion lowering of the drill head.

Another advantage is the addition of the centering tip on the dill head.

Another advantage is the addition of digging teeth on the outer perimeter of the drill tip plate to create a cleaner clearance hole.

Another advantage is using a nylon strap or limiting device within the square drill stem to cushion abrupt stopping of the drill head when the material is released.

Another advantage is using a hydraulic cylinder with a manual fluid flow control valve to cushion lowering of the drill head.

Another advantage is using a hydraulic cylinder along with a second hydraulic cylinder and a pilot operated check valve to control and cushion the lowering and latching of the drill head.

Another advantage will be the addition of the bowtie configuration of the drill tip plate along with the two orifices in the drill head plate creating the ability to fill the drill bucket faster.

These together with other advantages of the Axially separating drill bucket along with the various features of novelty, which characterize the design, are pointed out with particularity in the claims annexed to and forming a part of this disclosure. In this respect, before explaining at least one of the embodiments of the Axially separating drill bucket in detail it is to be understood that the design is not limited in its application to the details of construction and to the composition set forth in the following description or illustrated in the drawings The Axially separating drill bucket is controlled by the means of heavy equipment, commonly called the drill rig, with a drill boom that rotatably activates a conventional Kelly bar attached to the device. A unit called the sombrero is a fixed pan of the drill boom that the Kelly bar passes through extending to a box section of the Axially separating drill bucket assembly. The Kelly bar attaches to the box section by a variety of connection means but most often by the means of a square section inserted in a square orifice with a locking retainer. The box section is permanently attached to the drill stem that can be either a round or square cross section and extends through the drill bucket to be connected to the drill head. The drill bucket consists of a heavy walled steel tubular member open at one end and closed at the other h the means of a heavy steel cap plate welded in place. In the center of the cap plate on the preferred embodiment is an orifice where the drill stem passes through and the drill bucket translates up and down.

A long vertical key section is part of the drill stem that engages in a key slot in the steel cap plate keeping the drill bucket from rotating when the Axially separating drill bucket assembly is turning A pusher plate can be permanently attached to the drill stem in order to push the material out of the drill bucket central cavity when drill bucket is raised.

In the preferred embodiment the drill bucket will be raised by a single external scissor action mechanism on the outside of the drill bucket above the steel cap plate. The actuator member translates through an elongated slot of the box section to pivotally attach to the first scissor section that rotates about a pivot attached to the drill stem. At the distal end of the first scissor section is a pivoting link attached to a pivot lug fixed to the upper surface of the steel cap plate. A second similar external scissor action mechanism can be added on the other side of the drill stem to equalize the forces required to raise the drill bucket. When the Axially separating drill bucket is raised above the surface the actuator member makes contact with the stationary sombrero exerting a downward force raising the drill bucket. The elongated slot in the box section keeps the mechanism from being clogged when in operation.

In the first alternate embodiment of the Axially separating drill bucket where the drill bucket will be raised by a single internal scissor action mechanism within the drill bucket. In this process the actuator member translates through an elongated slot of the box section and an elongated slot in the steel cap plate to pivotally attach to the first scissor section that rotates about a pivot point on the drill stem. At the distal end of the first scissor section the second scissor section is pivotally attached with its distal end pivotally attached to a pivot lug fixed to the under surface of the steel cap plate. When the Axially separating drill bucket is raised, the actuator member makes contact with the stationary sombrero exerting a downward force raising the drill bucket. The elongated slots in both the box section and the steel cap plate keep the mechanism from being clogged when in operation. A second similar scissor action mechanism within the drill bucket can be added on the other side of the drill stem to equalize the forces required to raise the drill bucket.

The drill head consists of a drill head plate that is permanently attached to the distal end of the drill stem. There may be several drill bucket alignment features with the first, being a beveled edge to the drill bucket mating with a beveled edge on the drill head plate. Another alignment feature will be a number of alignment tabs welded around the circumference of the drill head plate with anti-rotation stop blocks attached to the inner surface of the drill bucket to resist any twisting between the drill bucket and the drill head plate. Another alignment feature will be an extension of intermittent side segments of the lower surface of the drill bucket mating with cutouts in the drill head plate. The drill tip plate has polarity of digging teeth and a central rod extending into as mating hole in the drill stem. A circumferential groove on the central rod aligns with a slot in the drill stem where a drill tip plate retainer allows the drill tip plate to rotate and be easily removed if necessary.

In the digging operation the drill tip plate with cutting teeth pivots against a stop plate welded on the drill head plate so that when rotating the Axially separating drill bucket the opening in the drill head plate is exposed with the material going into the drill bucket cavity. By reversing the rotation, the drill tip plate is forced in the opposite direction against a second stop plate closing the opening in the drill head plate so that the device can be raised to the surface without releasing the excavated material. The limiting stops, on the bottom surface of the drill head plate, act to keep the drill tip plate from making a full rotation in either direction.

A steel angle bar can be welded to the length of the inner surface of the drill bucket with an orifice in the steel cap plate and the drill head plate creating a separate cavity where water that might accumulate at the bottom of the hole could travel up through the Axially separating drill bucket. This is an option that can be incorporated into any of the embodiments of this application.

In the second alternate embodiment of the Axially separating drill bucket assembly, the process is to raise the drill bucket by the means of using a large capacity hydraulic cylinder attached to the box section with an actuator member extending up to make contact with the sombrero when the Axially separating drill bucket is raised above the surface. This contact forces the hydraulic fluid into a smaller and longer hydraulic cylinder attached to a lug on the upper surface of the steel cap plate raising the drill bucket away from the drill head plate. Additionally, a second smaller and longer hydraulic cylinder connected to the same large capacity hydraulic cylinder, would be attached to a second lug on the other side of the drill stem on the upper surface of the steel cap plate to equalize the forces required to raise the drill bucket.

A third alternate embodiment of the Axially separating drill bucket assembly w use the large capacity hydraulic cylinder with actuator member extending up to make contact with the sombrero when the Axially separating drill bucket assembly is raised above the surface. This contact forces the hydraulic fluid into a second set of smaller and longer hydraulic cylinders attached to a lug on the under surface of the steel cap plate raising the drill bucket away from the drill head plate.

A forth alternate embodiment of the Axially separating drill bucket assembly will use the large capacity hydraulic cylinder attached to the box section that is permanently attached to the drill stem with the actuator member extending up to make contact with the sombrero when the Axially separating drill bucket assembly is raised above the surface. The drill bucket will be welded permanently to the drill stem and hydraulic fluid forced into one or more smaller and longer hydraulic cylinders attached to a lug on the under surface of the steel cap plate. This action lowers the drill bead plate by the means of a telescoping stem inner member that is an integral part of the drill head plate.

A fifth alternate embodiment of the Axially separating drill bucket assembly will have the actuating rod spring loaded against the top surface of the drill bucket. The drill bucket and drill stem are welded together with a telescoping stem inner member part of the drill head plate. The actuating rod is welded to the steel drill head plate so that when it comes in contact with the sombrero on the surface the spring is compressed and the drill head plate is lowered away from the drill bucket.

The sixth alternate embodiment of the Axially separating drill bucket assembly will have a spring loaded latching mechanism holding the drill head up against the drill bucket with an actuator member extending up through the steel cap plate. The box section is permanently attached to the steel cap plate with the Kelly bar held in place by the means of the locking retainer. When the Axially separating drill bucket assembly is raised the actuator member makes contact with the Sombrero releasing the telescoping drill stem extension to lower by the means of gravity until it hits the stop on the lower inner surface of the drill bucket.

Another embodiment of the Axially separating drill bucket assembly will have a spring loaded latching mechanism incorporating a spring loaded push rod and a central hydraulic cylinder. The spring loaded push rod translates downward through the tubular guide with the angled lower section that activates the spring loaded latching mechanism when pressure is applied by the sombrero as the Axially separating drill bucket assembly is raised. An enlarged tubular guide section of the tubular guide limits the downward travel when pushed downward by the sombrero. The spring loaded push rod translates further downward pressing the pusher plate down to assist in emptying the drill bucket A hydraulic cylinder is housed within the outer tubular square drill stem and the inner tubular square drill stem anchored at the top by the means of the cross pin in the inner tubular drill stem and at the bottom in the outer tubular drill stem by the means of the cross pin. The drill head is at the lower end of the drill bucket.

Another embodiment of the Axially separating drill bucket assembly will have the spring loaded latching mechanism with a nylon strap replacing the hydraulic cylinder to lower the drill head to a cushioned lower position. The strap will be held by the means of the cross pin in the inner tubular drill stem and at the bottom in the outer tubular drill stem by the means a second cross pin.

Another embodiment of the Axially separating drill bucket assembly with the spring loaded latching mechanism will have the hydraulic cylinder where the fluid flow is controlled through the hydraulic lines to the manual hydraulic fluid flow control valve attached to the exterior of the drill bucket or within the cab of the drill rig to control the descent of the drill head.

Another embodiment of the Axially separating drill bucket assembly having the drill head released by the means of the sombrero pressing down on the activation rod of a second hydraulic cylinder to open pilot operated check valve to release and control descent of the drill head through the hydraulic cylinder.

The Axially separating drill bucket assembly will have an interlocking system between the drill head plate and the drill bucket where the segments of the drill bucket interlock with the cavities in the drill head plate to create a rigid structure. In this embodiment the drill head plate has two orifices into the central cavity of the drill bucket constructed in a bow tie shape with the digging teeth on either side Digging teeth can additionally be added around the perimeter of the drill tip plate. Two stop blocks are welded on the drill head plate to limit the rotation of the drill tip plate to a point of opening or covering the two orifices and trapping the material within the drill bucket central cavity. A replaceable centering tip, with digging teeth, is located on the drill tip plate.

The foregoing has outlined rather broadly the more pertinent and important features of the present Axially Separating Drill Bucket in order that the detailed description of the application that follows may be better understood so that the present contribution to the art may be more fully appreciated. Additional features of the design will be described hereinafter which form the subject of the claims of this disclosure. It should be appreciated by those skilled in the art that the conception and the disclosed specific embodiment may be readily utilized as a basis for modifying or designing other structures and methods for carrying out the same purposes of the present design. It should also be realized by those skilled in the art that such equivalent constructions and methods do not depart from the spirit and scope of this application as set forth in the appended claims.

BRIEF DESCRIPTION OF THE DRAWINGS

The accompanying drawings, which are incorporated in and form a part of this specification, illustrate embodiments of the Axially Separating Drill Bucket and together with the description, serve to explain the principles of this application.

For a fuller understanding of the nature and advantages of the Axially Separating Drill Bucket, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

Figure 1:
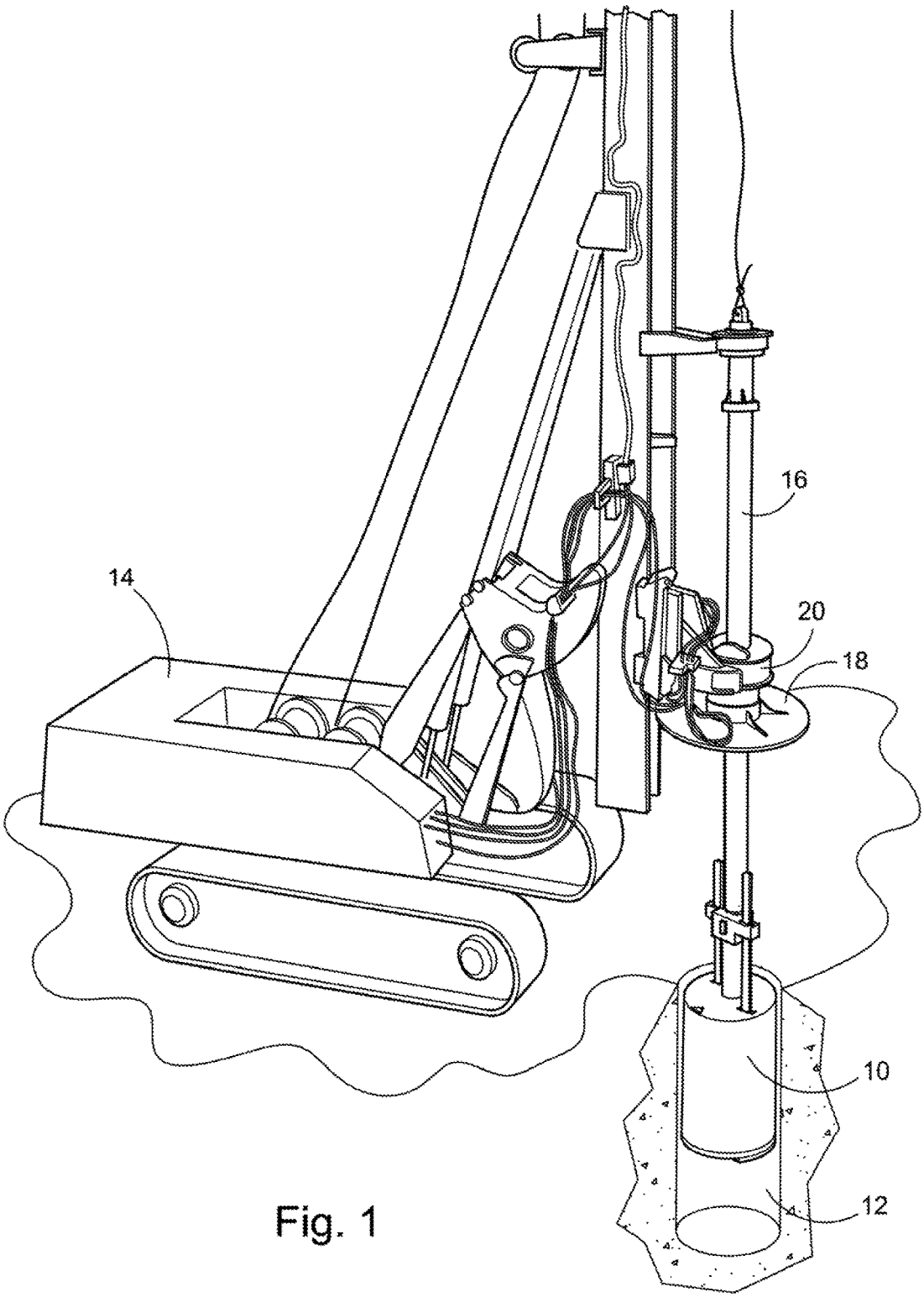
FIG. 1 depicts a perspective drawing of the Axially Separating Drill Bucket being lowered into a hole by the means of a drill rig.

Referring now to the drawings, wherein similar parts of the Axially Separating Drill Bucket 10 are identified by like reference numerals, there is seen in FIG. 1 a perspective drawing of the Axially separating drill bucket 10 being lowered into a hole 12 by the means of a drill rig 14 with the Kelly bar 16 extending through the stationary sombrero 18 below the rotational drive mechanism 20.

Figure 2:
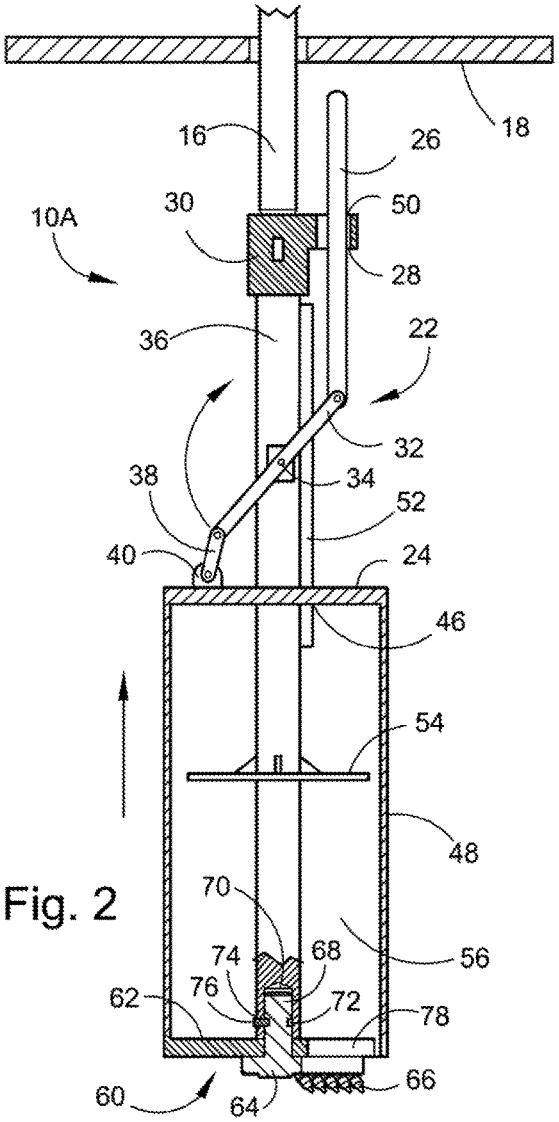
FIG. 2 depicts a cross sectional view of the preferred embodiment of the Axially Separating Drill Bucket with a single external scissor action movement having the drill head in upper position.

FIG. 2 depicts a cross sectional view of the preferred embodiment of the Axially Separating Drill Bucket 10A with a single external scissor action movement 22 on the outside of the drill bucket above the steel cap plate 24 where the actuator member 26 translates through an elongated slot 28 of the box section 30 to pivotally attach to the first scissor section 32 that rotates about a pivot 34 attached to the drill stem 36. At the distal end of the first scissor section 32 is a pivoting link 38 attached to a pivot lug 40 fixed to the upper surface of the steel cap plate 24. When the Axially Separating Drill Bucket 10A is raised above the surface the actuator member 26 makes contact with the stationary sombrero 18 exerting a downward force raising the drill bucket 48. The elongated slot 50 in the box section 30 keeps the mechanism from being clogged when in operation. A long vertical key 52 is part of the drill stem 36 that engages in a key slot 46 in the steel cap plate 24 securing the drill bucket 48 to the drill stem 36 when the Axially Separating Drill Bucket 10A is rotated. A pusher plate 54 can be permanently attached to the drill stem 36 in order to push the material out of the drill bucket central cavity 56 when drill bucket 48 is raised.

At the lower distal end of the drill stem 36 is the drill head 60 consisting of a drill head plate 62 that is permanently attached to the distal end of the drill stem 36. A drill tip plate 64 located below the drill head plate 62 has polarity of digging teeth 66 and a central rod 68 extending into a mating hole 70 in the drill stem 36. A circumferential groove 72 in the central rod 48 aligns with a slot 74 in the drill stem 36 where a drill tip plate retainer 76 allows the drill tip plate 64 to rotate and be easily removed if necessary. An opening 78 ahead of the digging teeth 66 of the drill tip plate 64 allows the excavated material to enter the drill bucket central cavity 56.

Figure 3:
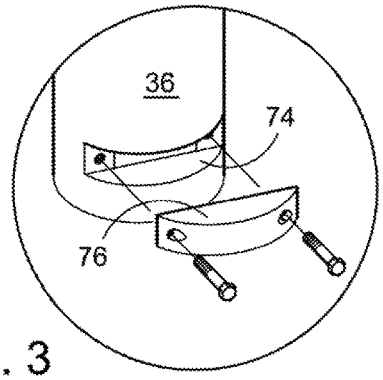
FIG. 3 depicts an exploded view of the retainer in the drill stem securing the drill tip plate into position.

FIG. 3 depicts an exploded view of the drill tip plate retainer 76 in the drill stem 36 securing the drill tip plate 64 into position.

Figure 4:
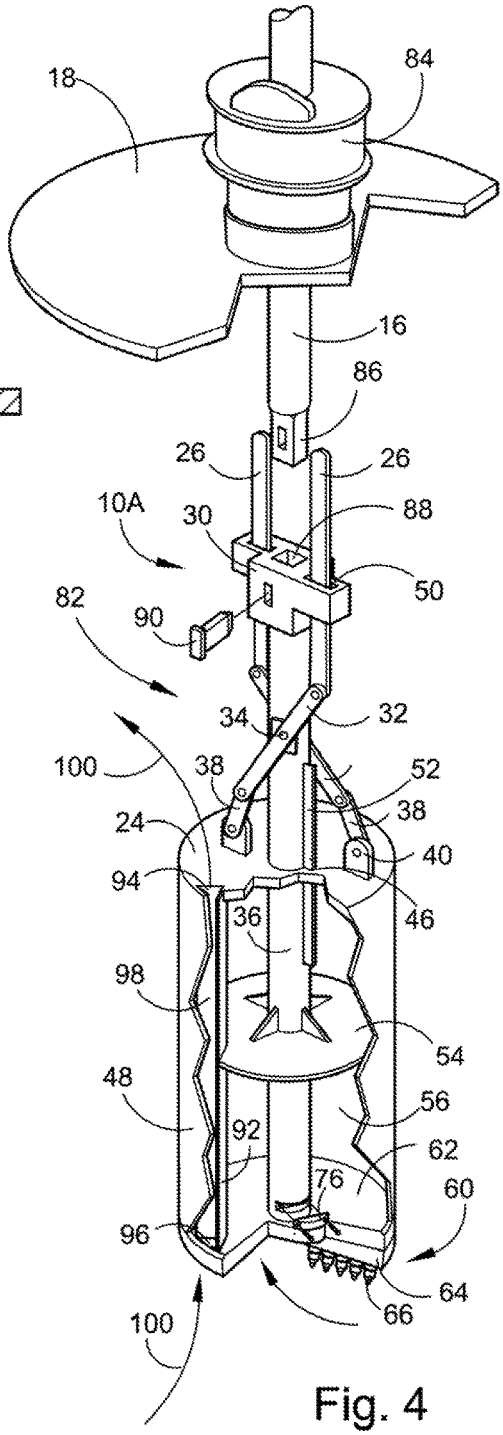
FIG. 4 depicts a perspective view of the preferred embodiment of the Axially Separating Drill Bucket with a double external scissor action movement having the drill head in upper position.

FIG. 4 depicts a perspective view of the preferred embodiment of the Axially Separating Drill Bucket 10A with a second external scissor action movement 82 having the drill head 60 in upper position. The rotational drive mechanism 84 is located above the sombrero 18 with the Kelly bar 16 having a square distal end 86 that will mate with the square orifice 88 in the box section 30 using the locking pin 90 to secure it in place. A steel angle bar 92 welded to the length of the inner surface of the drill bucket 48 with an upper orifice 94 in the steel cap plate 24 and a lower orifice 96 in the drill head plate 62 creates a separate water transfer channel 98 where water 100 might accumulate at the bottom of the hole 12 that can travel up through the Axially separating drill bucket 10A assembly during the drilling operation. This is an option that can be incorporated into any of the embodiments of this application.

Figure 5:
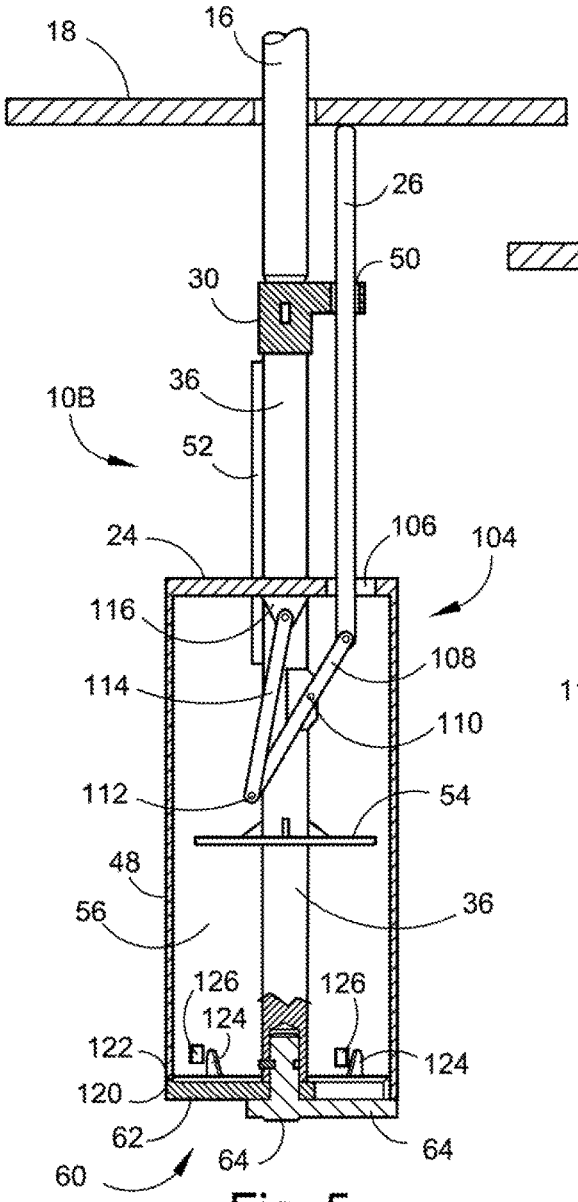
FIG. 5 depicts a cross sectional view of the first alternate embodiment of the Axially Separating Drill Bucket with a single internal scissor action movement having the drill head in the upper position.

FIG. 5 depicts a cross sectional view of the first alternate embodiment of the Axially Separating Drill Bucket 10B where the drill bucket 48 will be raised by a single internal scissor action mechanism 104 within the drill bucket 48. In this action an actuator member 26 translates through an elongated slot 50 of the box section 30 and an elongated slot 106 in the steel cap plate 24 to pivotally attach to the first scissor section 108 that rotates about a pivot 110 attached to the drill stem 36. At the distal end 112 of the first scissor section 108 the second scissor section 114 is pivotally attached with its distal end pivotally attached to a pivot lug 116 fixed to the under surface of the steel cap plate 24. When the Axially separating drill bucket 108 is raised the actuator member 26 makes contact with the stationary sombrero 18 exerting a downward force raising the drill bucket 48. The elongated slots 50 and 106 in both the box section 30 and the steel cap plate 24 keep the mechanism from being clogged when in operation. There may be several drill bucket 48 alignment features with the first, being a beveled edge 120 to the drill bucket 48 mating with a beveled edge 122 on the drill head plate 62. Another alignment feature will be a number of alignment tabs 124 welded around the circumference of the drill head plate 62 with anti-rotation stop blocks 126 attached to the inner surface of the drill bucket 48 to resist any twisting between the drill bucket 48 and the drill head plate 62.

Figure 6:
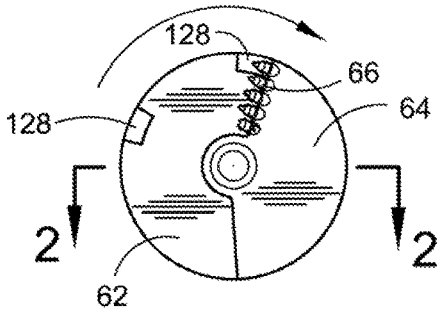
FIG. 6 depicts a bottom view of the Axially Separating Drill Bucket with the drill tip plate rotated closing the opening in the drill head plate.

FIG. 6 depicts a bottom view of the Axially Separating Drill Bucket 10B with the drill tip plate 64 rotated closing the opening 78 in the drill head plate 62. The two rotational stops 128 are welded to the bottom surface of the drill head plate 62.

Figure 7:
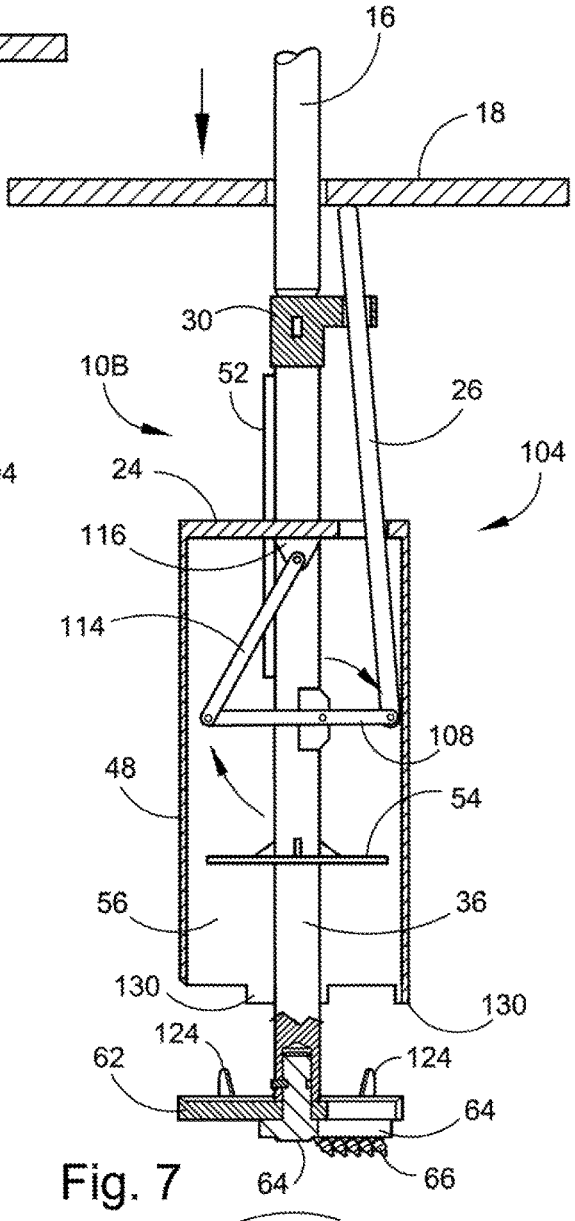
FIG. 7 depicts a cross sectional view of the first alternate embodiment of the Axially Separating Drill Bucket with the single internal scissor action movement having the drill head in the partially extended position.

FIG. 7 depicts a cross sectional view of the first alternate embodiment of the Axially Separating Drill Bucket 10B with the single internal scissor action movement 104 having the drill head 60 in the partially extended position. Another optional alignment feature illustrated will be an extension of intermittent side segments 130 of the lower surface of the drill bucket 48 mating with cutouts in the drill head plate 62.

Figure 8:
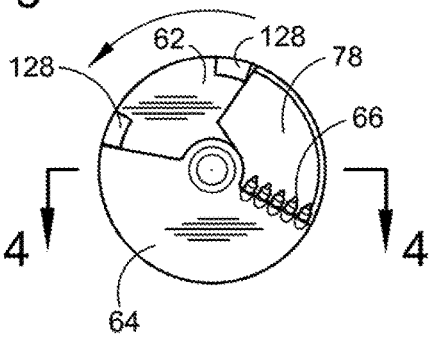
FIG. 8 depicts a bottom view of the Axially Separating Drill Bucket with the drill tip plate rotated exposing the opening in the drill head plate.

FIG. 8 depicts a bottom view of the Axially Separating Drill Bucket TUB with the drill tip plate 64 rotated exposing the opening 78 in the drill head plate 62 with the two rotational stops 128 welded to the bottom surface of the drill head plate 62.

Figure 9:
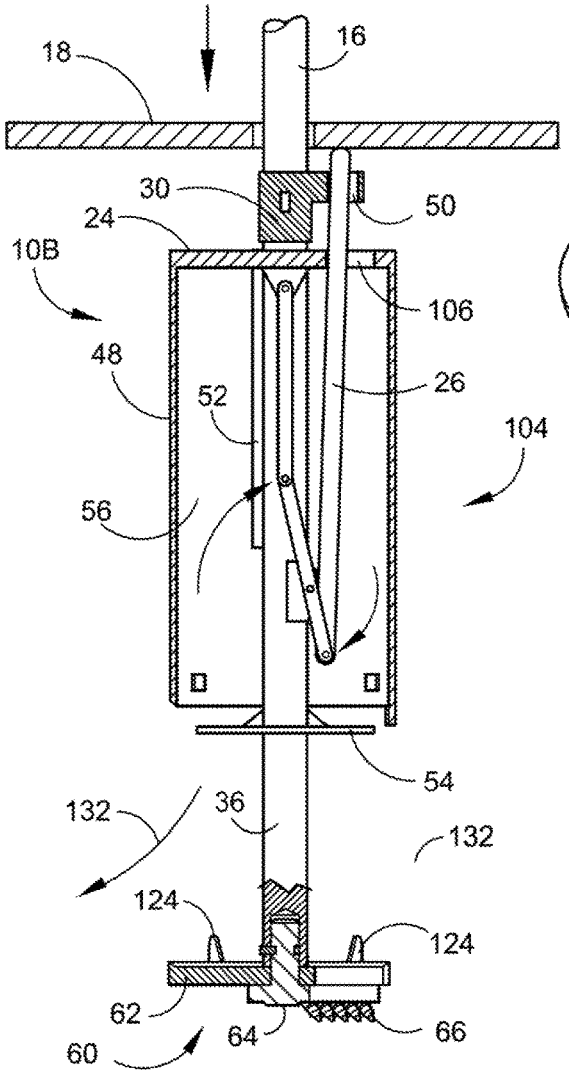
FIG. 9 depicts a cross sectional view of the first alternate embodiment of the Axially Separating Drill Bucket with the single internal scissor action movement having the drill head in the fully extended position.

FIG. 9 depicts a cross sectional view of the first alternate embodiment of the Axially Separating Drill Bucket 10B with the single internal scissor action movement 104 having the drill head 60 in the full extended position. The arrows 132 indicate the direction that the excavated material would be pushed out by the pusher plate 54.

Figure 10:
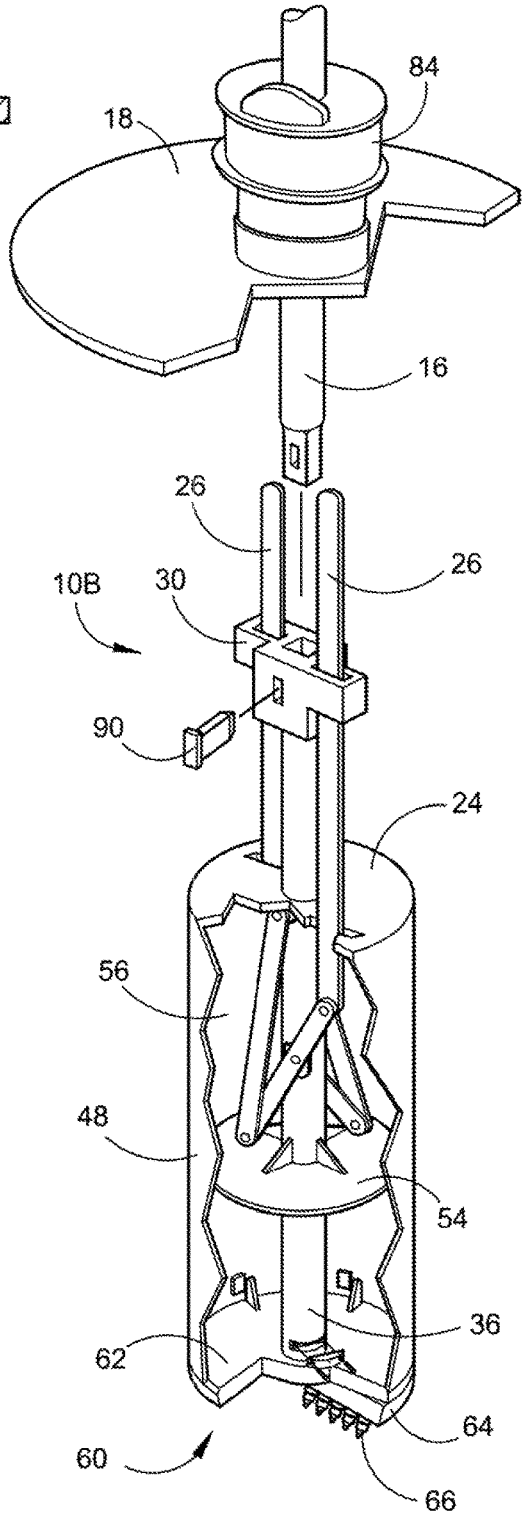
FIG. 10 depicts a perspective view of the first alternate embodiment of the Axially Separating Drill Bucket with a double internal scissor action movement having the drill head in upper position.

FIG. 10 depicts a perspective view of the first alternate embodiment of the Axially Separating Drill Bucket 10B with a second similar scissor action movement 104 within the drill bucket 48 that can be added on the other side of the drill stem 36 to equalize the farces required to raise the drill bucket 48.

Figure 11:
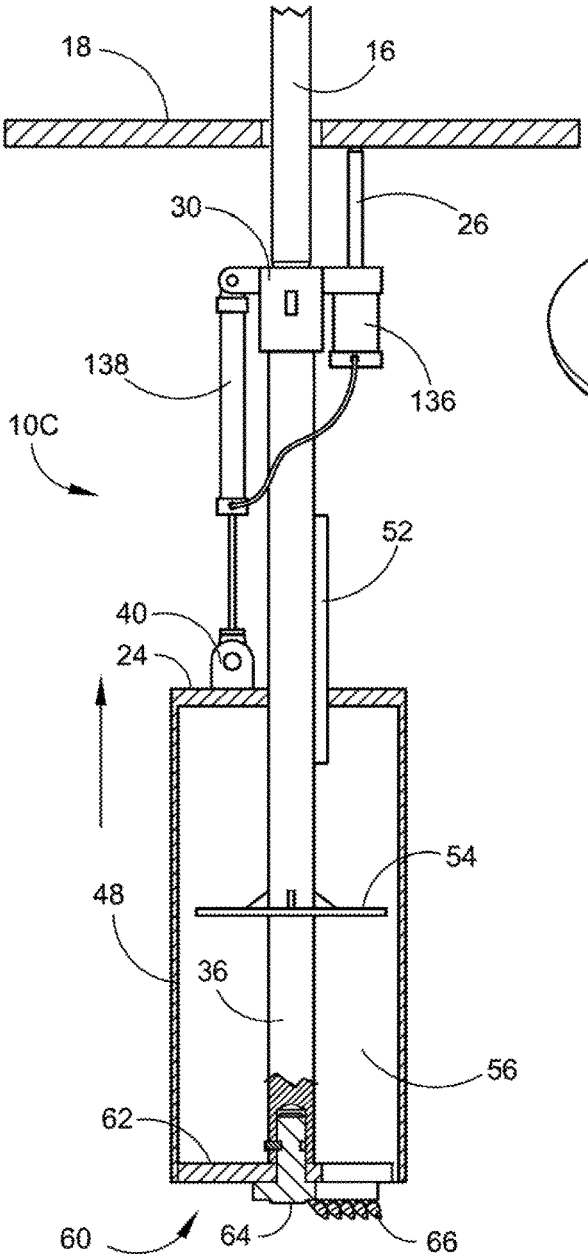
FIG. 11 depicts a cross sectional view of the second alternate embodiment of the Axially Separating Drill Bucket using a hydraulic method using a large capacity hydraulic cylinder connected to a smaller longer hydraulic cylinder to raise the drill bucket from the drill head.

FIG. 11 depicts a cross sectional view of the second alternate embodiment of the Axially Separating Drill Bucket 10C using a hydraulic method with a large capacity hydraulic cylinder 136 connected to a single smaller longer hydraulic cylinder 138 to raise the drill bucket 48 from the drill head 60. The large capacity hydraulic cylinder 136 attached to the box section 30 with an actuator member 26 extending up to make contact with the sombrero 18 when the Axially Separating Drill Bucket 10C is raised above the surface. This contact forces the hydraulic fluid into a smaller and longer hydraulic cylinder 138 attached to a lug 40 on the upper surface of the steel cap plate 24 raising the drill bucket 48 away from the drill head 60.

Figure 12:
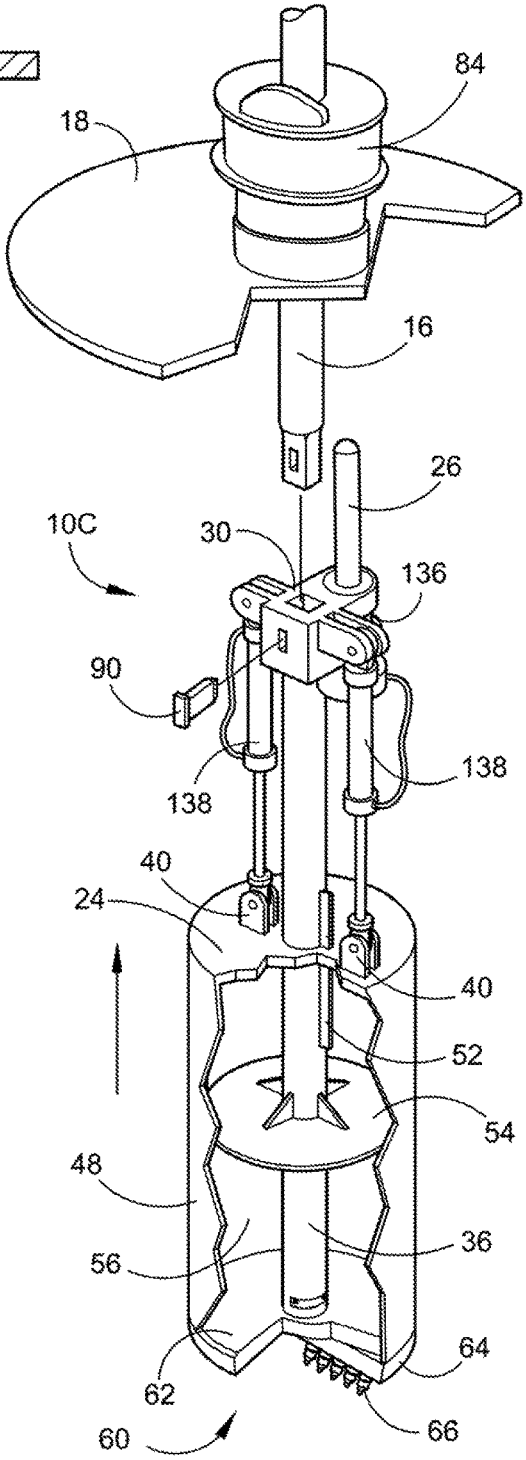
FIG. 12 depicts a perspective view of the second alternate embodiment of the Axially Separating Drill Bucket using a hydraulic method using a large capacity hydraulic cylinder connected to two smaller longer hydraulic cylinders to raise the drill bucket from the drill head.

FIG. 12 depicts a perspective view of the second alternate embodiment of the Axially Separating Drill Bucket 10C using a hydraulic method with a large capacity hydraulic cylinder 136 connected to two smaller longer hydraulic cylinders 138 to raise the drill bucket 48 from the drill head 60 to equalize the forces required to raise the drill bucket 48.

Figure 13:
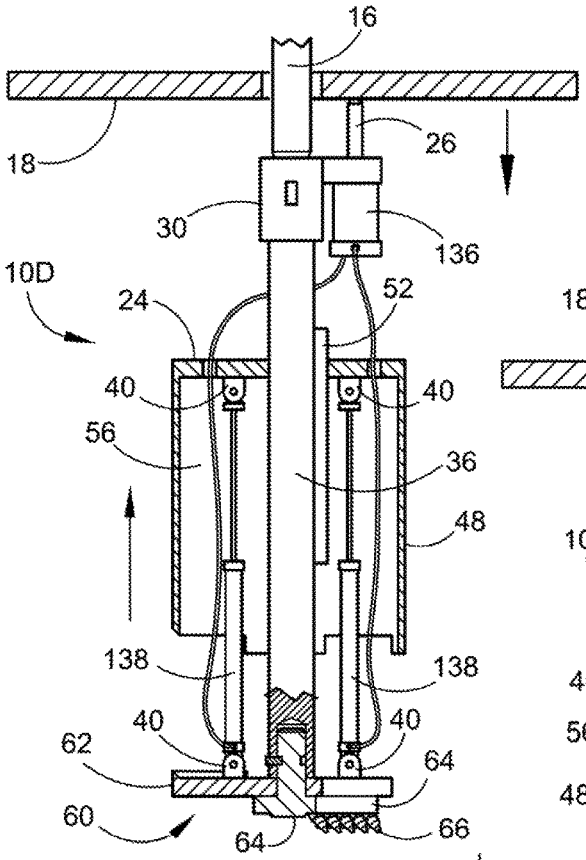
FIG. 13 depicts the third alternate embodiment of the Axially Separating Drill Bucket using a hydraulic method using a large capacity hydraulic cylinder connected to two smaller longer hydraulic cylinders to raise the drill bucket from the drill head.

FIG. 13 depicts cross sectional view of the third alternate embodiment of the Axially Separating Drill Bucket 10D using a hydraulic method with a large capacity hydraulic cylinder 136 connected to two smaller longer hydraulic cylinders 138 to raise the drill bucket 48 from the drill head 60.

Figure 14:
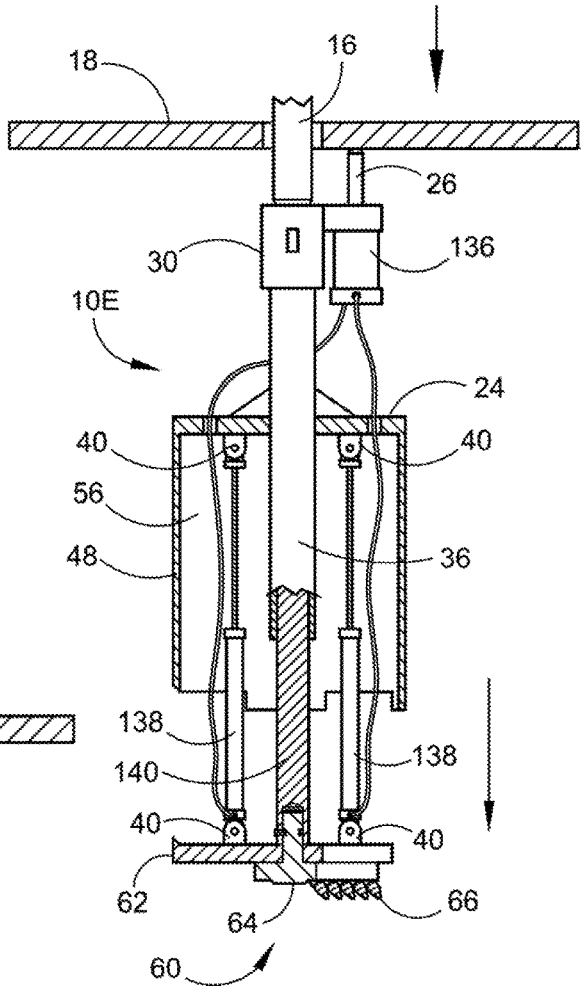
FIG. 14 depicts a cross sectional view of the forth alternate embodiment of the Axially Separating Drill Bucket having the drill bucket connected to the telescoping drill stem using a hydraulic method with a large hydraulic cylinder connected to two smaller longer hydraulic cylinders to lower the drill head using a telescoping drill stem.

FIG. 14 depicts a cross sectional view of the forth alternate embodiment of the Axially Separating Drill Bucket IDE having the drill bucket 48 permanently attached to the drill stem 36 using a hydraulic method with a large hydraulic cylinder 136 connected to two smaller longer hydraulic cylinders 138 to lower the drill head 60 using a telescoping drill stem 140 attached to the drill head 60.

Figure 15:
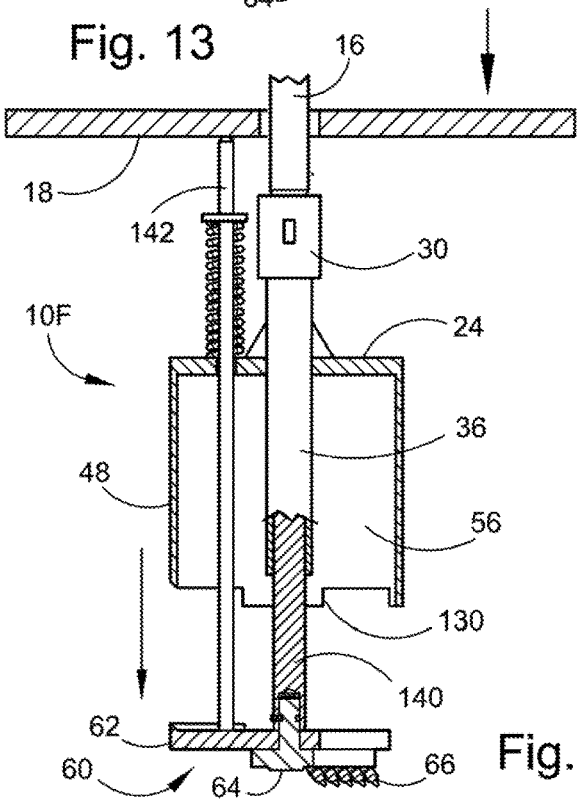
FIG. 15 depicts a cross sectional view of the fifth alternate embodiment of the Axially Separating Drill Bucket having the drill bucket connected to the telescoping drill stem and the spring loaded actuator member connected to the drill head. When the bucket is raised to the surface and the actuator comes in contact with the sombrero and the drill head is pushed down.

FIG. 15 depicts a cross sectional view of the fifth alternate embodiment of the Axially Separating Drill Bucket 10F having the drill bucket 48 connected to the telescoping drill stem 140 and the spring loaded actuator member 142 connected to the drill head 60. When the drill bucket 48 is raised to the surface and the actuator comes in contact with the sombrero 18 the drill head 60 is pushed down.

Figure 16:
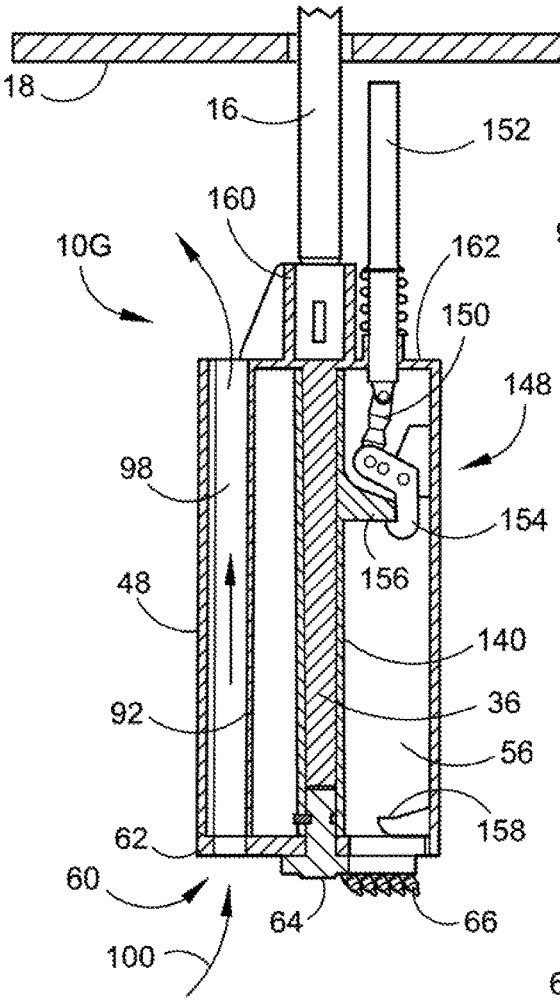
FIG. 16 depicts a cross sectional view of the sixth alternate embodiment of the Axially Separating Drill Bucket assembly having a spring loaded latching mechanism holding the drill head up against the drill bucket

FIG. 16 depicts a cross sectional view of the sixth alternate embodiment of the Axially Separating Drill Bucket 10G having a spring loaded latching mechanism 148 holding the drill head 60 up against the drill bucket 48. The spring loaded latching mechanism 148 operates by the means of the spring loaded actuator member 152 attached to the connector link 150 and the pivotal latch 154. The pivotal latch 154 is illustrated making contact with the latch catch 156 that is an integral part of the drill stem 36. A latch stop 158 is fixed to the lower rim of the drill bucket 48. In this embodiment the box section 160 is permanently attached to the steel cap plate 162.

Figure 17:
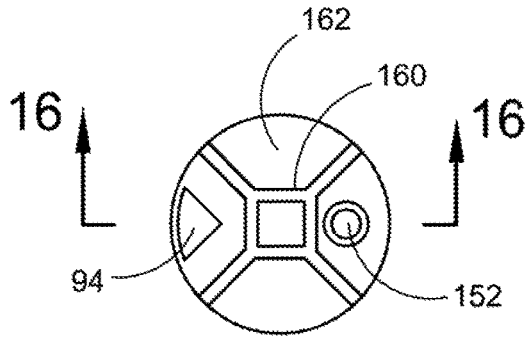
FIG. 17 depicts top view of the Axially Separating Drill bucket.

FIG. 17 depicts top view of the Axially Separating Drill Bucket 10G where the box section 160 is permanently attached to the steel cap plate 162 exposing the upper orifice 94 of the water transfer channel 98 and the end of the spring loaded actuator member 152.

Figure 18:
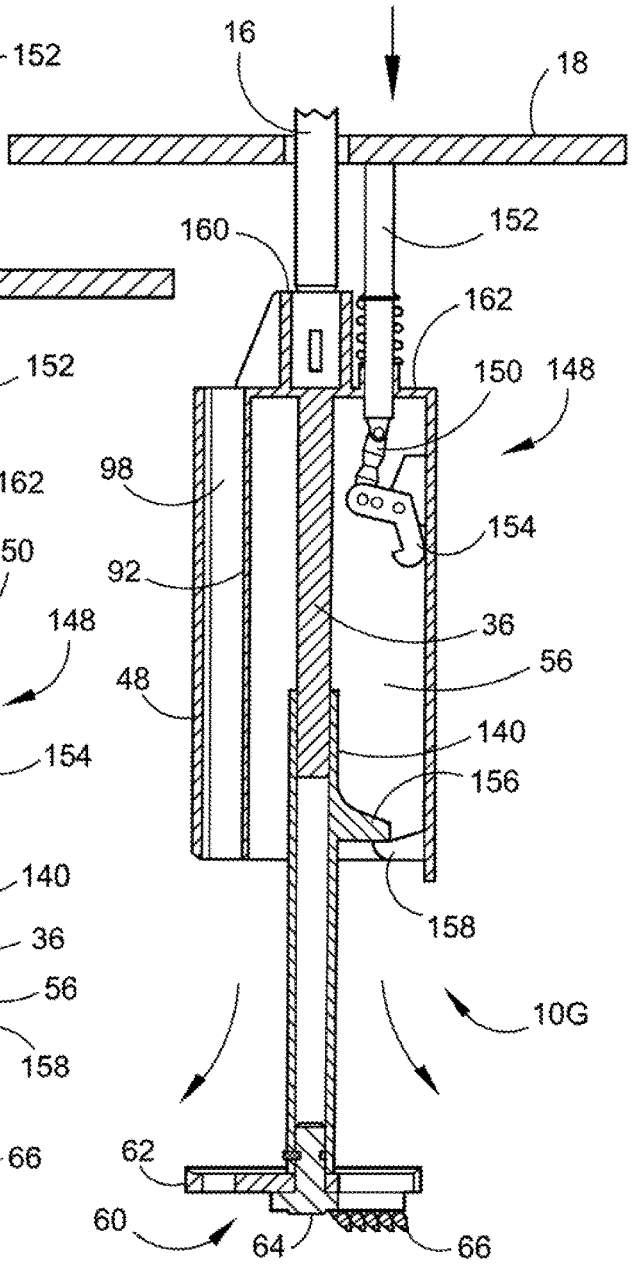
FIG. 18 depicts a cross sectional view of the sixth alternate embodiment of the Axially Separating Drill Bucket assembly having a spring loaded latching mechanism released with the drill head in the lowered position.

FIG. 18 depicts a cross sectional view of the sixth alternate embodiment of the Axially Separating Drill Bucket JOG having a spring loaded latching mechanism 148 released with the drill head 60 in the lowered position.

Figure 19:
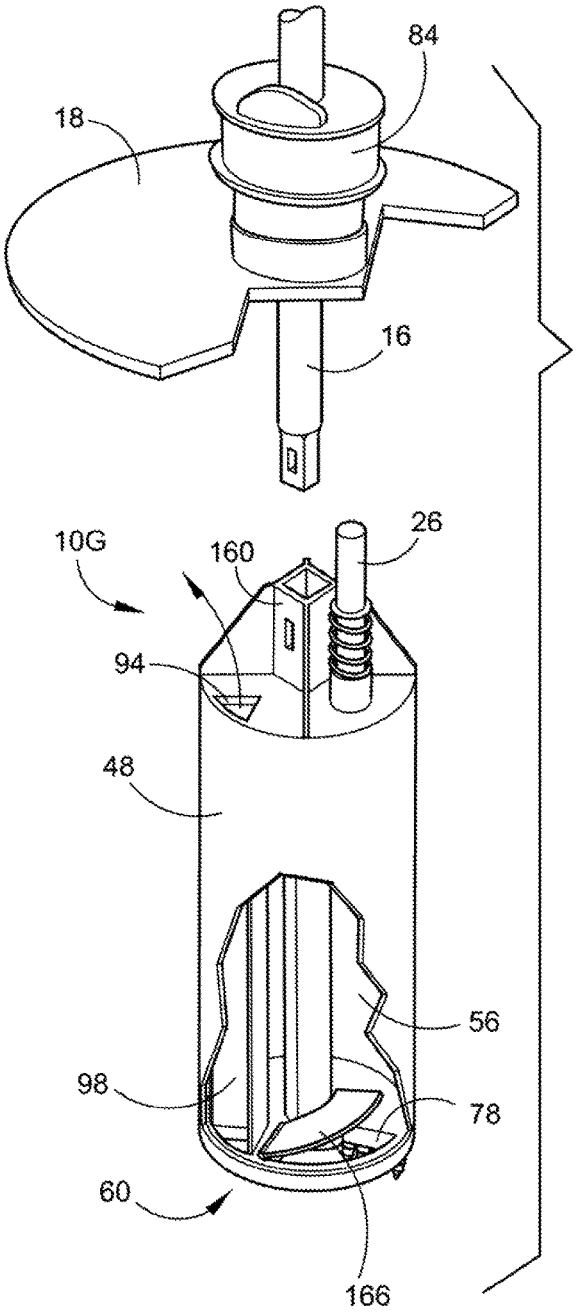
FIG. 19 depicts a perspective view of the sixth alternate embodiment of the Axially Separating Drill Bucket assembly having a spring loaded latching mechanism holding the drill head up against the drill bucket incorporating a flapper door open over the opening in the drill head plate with the water transfer channel exposed.

FIG. 19 depicts a perspective view of the sixth alternate embodiment of the Axially Separating Drill Bucket 10G having a spring loaded latching mechanism 148 holding the drill head 60 up against the drill bucket 48 incorporating a flapper door 166 open over the opening 78 in the drill head plate 62 with the water transfer channel 98 exposed.

Figure 20:
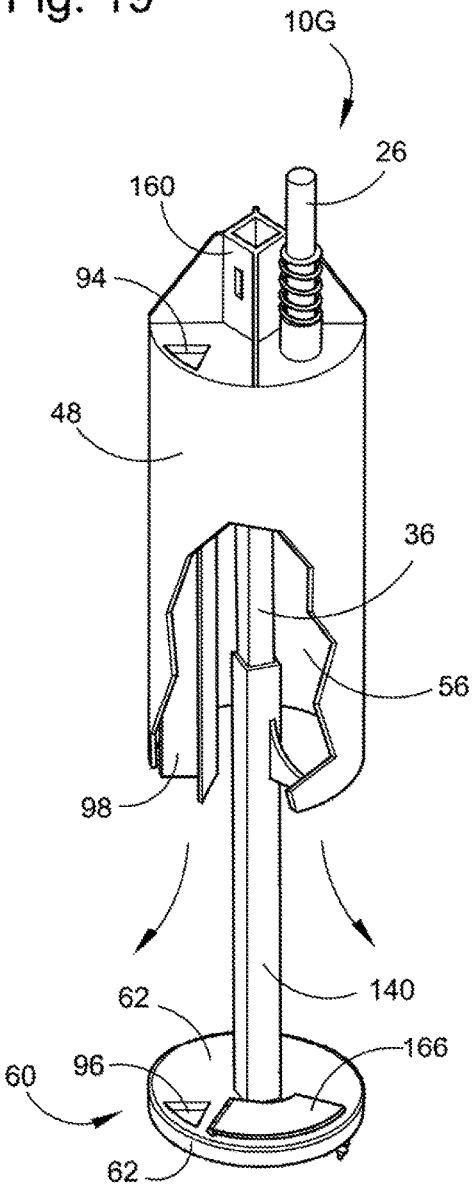
FIG. 20 depicts a perspective view of the sixth alternate embodiment of the Axially Separating Drill Bucket assembly having a spring loaded latching mechanism released and the drill bead in the lowered position incorporating a flapper closed over the opening in the drill head plate with the water transfer channel exposed.

FIG. 20 depicts a perspective view of the sixth alternate embodiment of the Axially Separating Drill Bucket 10G having a spring loaded latching mechanism 148 released and the drill head 60 in the lowered position incorporating a flapper door 166 closed over the opening 78 in the drill head plate 62 with the water transfer channel 98 exposed.

Figures 21A, 21B:
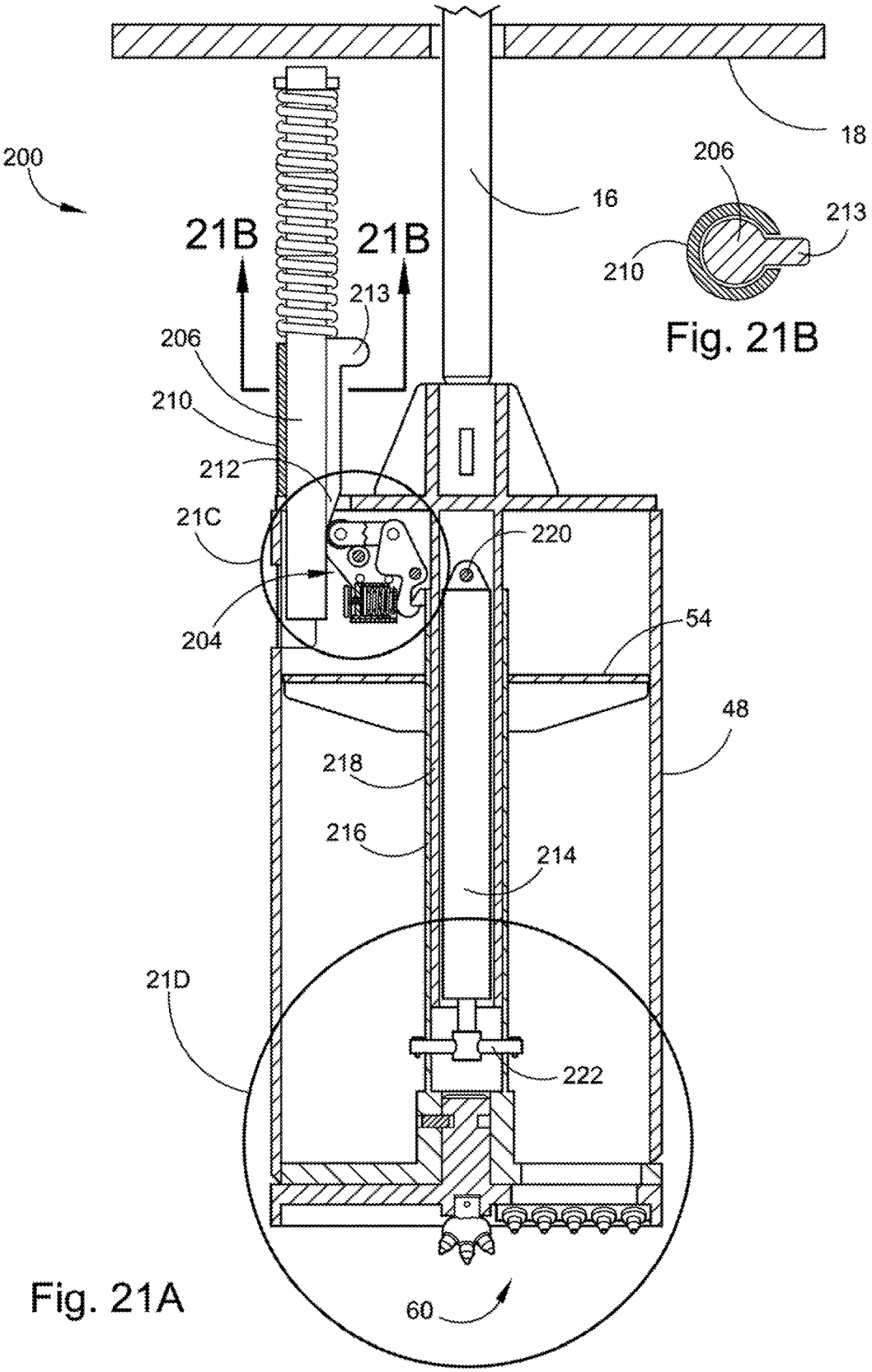
FIG. 21A depicts a cross section side view of another embodiment of the Axially Separating Drill Bucket assembly having a spring loaded latching mechanism incorporating a push rod and a central hydraulic cylinder.
FIG. 21B depicts a top plan view of the spring loaded push rod and the guide stop section, in relation to the tubular guide.
Figure 21C:
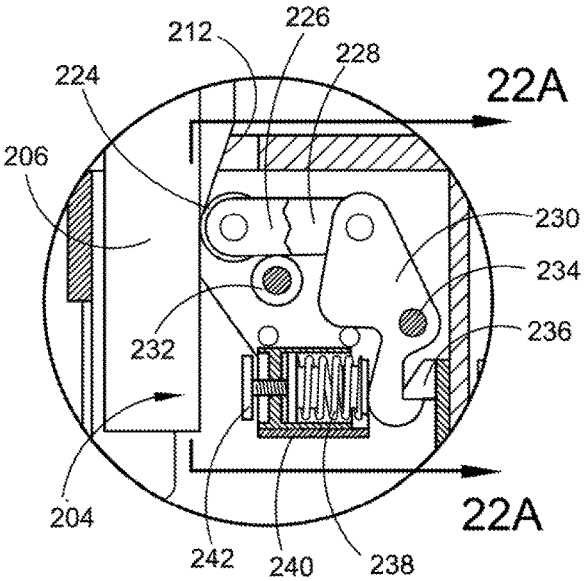
FIG. 21C depicts an enlarged cross section of the spring loaded latching mechanism.

FIG. 21A depicts a cross section side view of another embodiment of the Axially Separating Drill Bucket assembly 200 having a spring loaded latching mechanism 204 incorporating a spring loaded push rod 206 and a central hydraulic cylinder 214. The spring loaded push rod 206 translates downward through the tubular guide 210 with the angled lower section 212 that activates the spring loaded latching mechanism 204 when pressure is applied by the sombrero 18 as the Axially separating drill bucket assembly 200 is raised. A guide stop section 213 located at the top of the "tapered wedge" shaped portion of the push rod 206 protrudes out from the tubular guide 210 surrounding the push rod 206 and limits the downward travel when push rod 206 is pushed downward by the sombrero 18. The spring loaded push rod 206 translates further downward pressing the pusher plate 54 down to assist in emptying the drill bucket 48. A hydraulic cylinder 214 is housed within the outer drill stem 216 and the inner drill stem 218 anchored at the top by the means of the cross pin 220 in the inner drill stem 218 and at the bottom in the outer drill stem 216 by the means of the cross pin 222. The drill head 60 is at the lower end of the drill bucket 48.

FIG. 21B depicts a top plan view of the spring loaded push rod 206 and the guide stop section 213 in relation to the tubular guide 210.

Figures 23A, 23B:
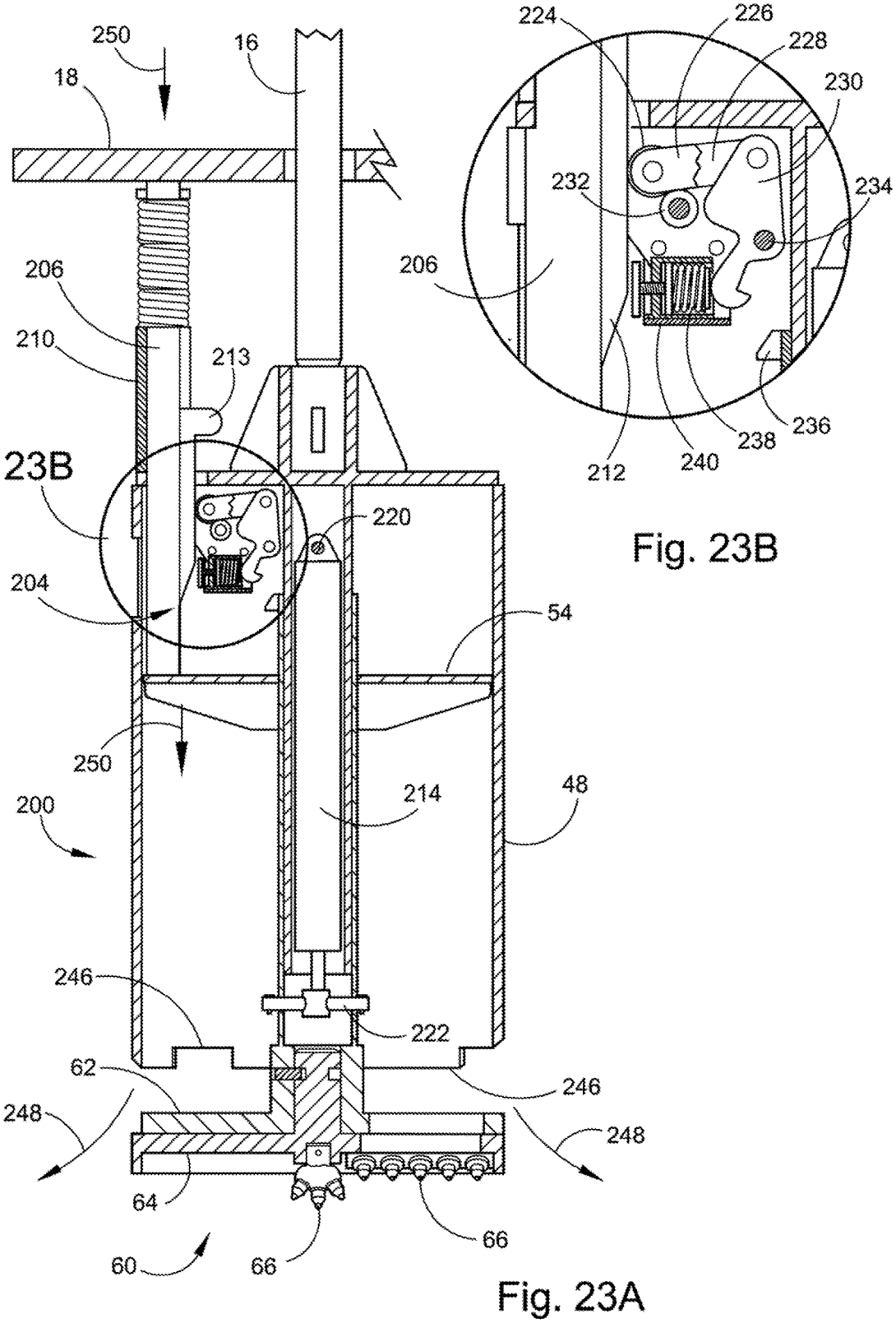
FIG. 23A depicts a cross section side view of the Axially Separating Drill Bucket assembly having the spring loaded latching mechanism released by the means of the angled lower section of the spring loaded push rod.
FIG. 23B depicts an enlarged cross section of the spring loaded latching mechanism released by the means of the tapered section of the push rod.

FIG. 21B depicts an enlarged cross section of the spring loaded latching mechanism 204 where more clearly depicted is the lower end of the spring loaded push rod 206 and the angled lower section 212 of the "tapered wedge" shaped portion of the push rod 206 protruding out from tubular guide 210. The angled lower section 212 of push rod 206 is against the actuating roller 224 between the two links 226 and 228 which are pivotally attached to the upper end on the latching mechanism 230. The support roller 232 maintains the location of the actuating roller 224 before the spring loaded push rod 206 is moved downward. The latching mechanism 230 pivots about the pivot pin 234 to release the catch 236 on the outer drill stem 216 to lower the drill head 60. The latching mechanism 230 is held against the catch 236 on the outer surface of the outer drill stem 216 by the means of the spring 238 in the spring housing 240. The spring 238 tension can be adjusted by the adjustment screw 242. See also further detail as shown in FIG. 23B.

Figure 21D:
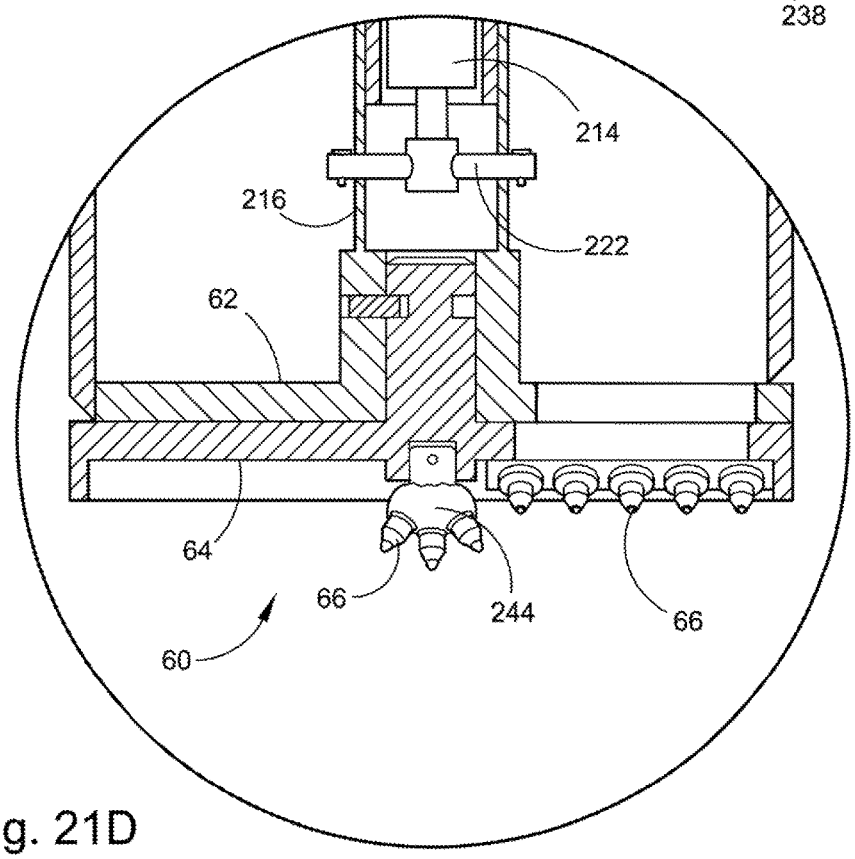
FIG. 21D depicts an enlarged cross section of the drill head end of the Axially Separating Drill Bucket assembly with the mounting end of the hydraulic cylinder.

FIG. 21D depicts an enlarged cross section of the drill head 60 of the Axially Separating Drill Bucket assembly 200 with the mounting end of the hydraulic cylinder 214 connected to the outer tubular square drill stem 216 and the drill head plate 62 by the means of the cross pin 222. A replaceable centering tip 244 with digging teeth 66 is attached to the drill tip plate 64.

Figure 22A:
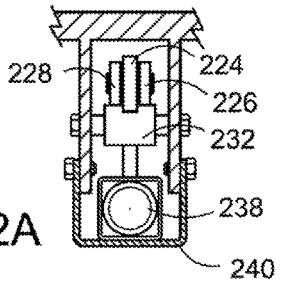
FIG. 22A depicts an end view of the spring loaded latching mechanism.

FIG. 22A depicts an end view of the spring loaded latching mechanism 204 illustrating the two links 226 and 228, the actuating roller 224, the support roller 232, and the spring housing 240 and spring 238.

Figure 22B:
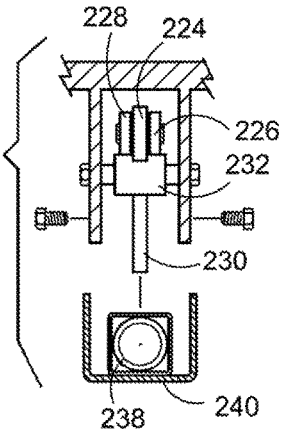
FIG. 22B depicts an exploded end view of the spring loaded latching mechanism.

FIG. 22B depicts an exploded end view of the spring loaded late ling mechanism 204 with the spring housing 240 moved down for maintenance.

FIG. 23A depicts a cross section side view of the Axially Separating Drill Bucket assembly 200 having the spring loaded latching mechanism 204 released by the means of the angled lower section 212 of the "tapered wedge" shaped portion of the push rod 206 being moved down by the sombrero 18 releasing the latching mechanism 230 while pushing the spring loaded push rod 206 on down against the material pusher plate 54 along with the controlled downward movement of the drill head 60 by the means of the central hydraulic cylinder 214. The drill head 60 is shown lowered from the drill bucket 48 illustrating the interlocking lower edge 246 of the drill bucket 48 interconnecting with the edge of the drill head plate 62 serving to secure the two parts together until the drill head 60 is lowered. The arrows 248 indicate the movement of the material within the drill bucket 48 and arrows 250 indicate downward pressure to remove the material in the drill bucket 48. See also further detail as shown in FIG. 23B.

FIG. 23B depicts an enlarged cross section of the spring loaded latching mechanism 204 released by the means of the angled lower section 212 of the "tapered wedge" shaped portion of the push rod 206 protruding out from the tubular guide 210 surrounding the push rod 206 has been rotated back away from the catch 236 on the outer drill stem 216 and compressing the spring 238. In this way, the angled lower section 212 of the "tapered wedge" shaped portion of the push rod 206 acts to activate the latch, while the guide stop section 213 located at the top of the "tapered wedge" shaped portion of the push rod 206 protrudes out from the tubular guide 210 and limits the downward travel when pushed downward by the force of making contact with the sombrero 18.

Figure 24:
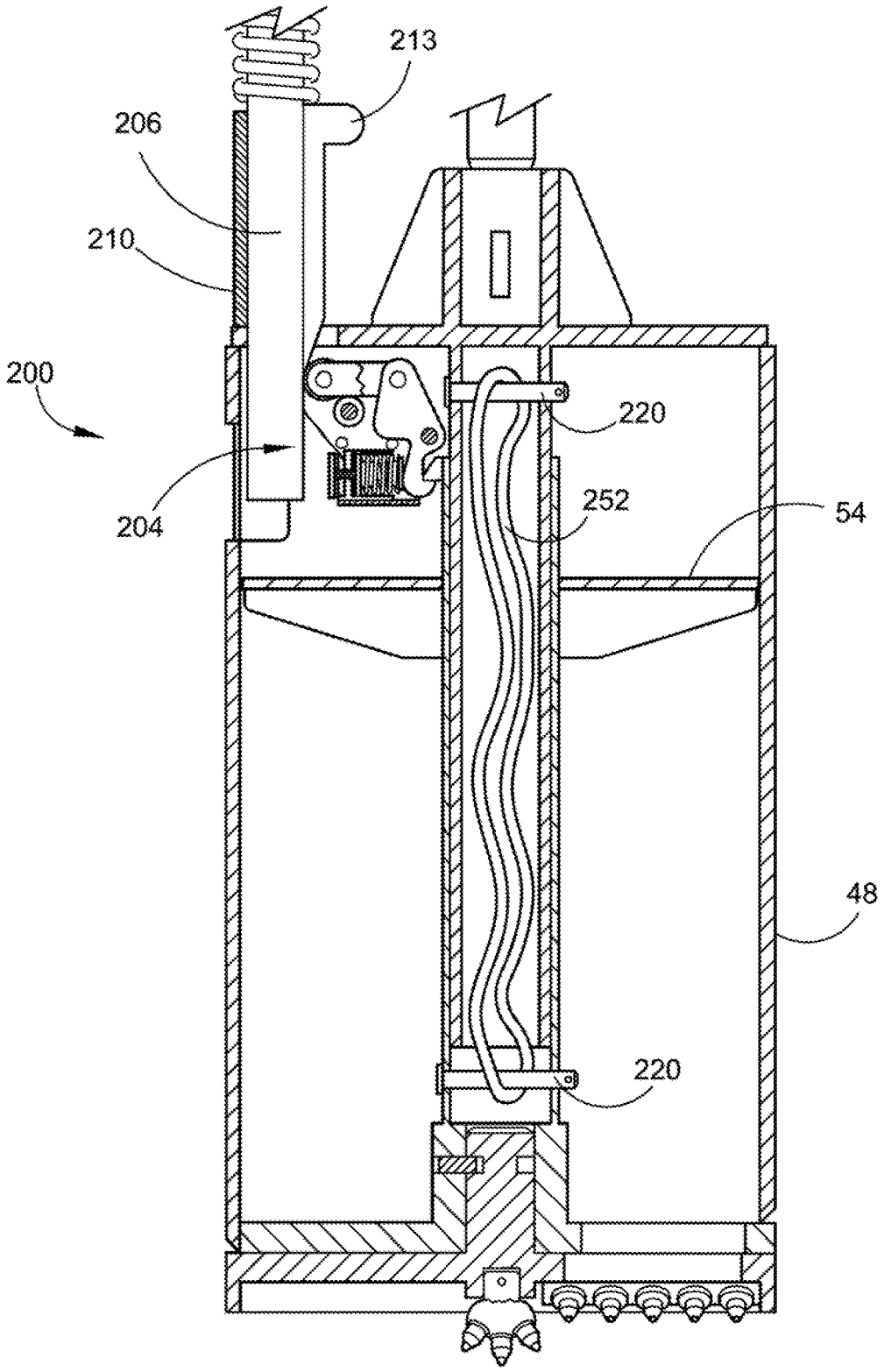
FIG. 24 depicts a cross section side view of another embodiment of the Axially Separating Drill Bucket assembly having the spring loaded latching mechanism with a nylon strap replacing the hydraulic cylinder.

FIG. 24 depicts a cross section side view of another embodiment of the Axially Separating Drill Bucket assembly 200 having the spring loaded latching mechanism 204 with a nylon strap 252 replacing the hydraulic cylinder 214 to lower the drill head 60 to a cushioned lower position. The strap will be held by the means of the cross pin 220 in the inner tubular drill stem 218 and at the bottom in the outer tubular drill stem 216 by the means of the cross pin 222. It must be understood that any form of elastic, spring, chain or limiting mechanism could function for this purpose and still remain within the scope of this application.

Figure 25:
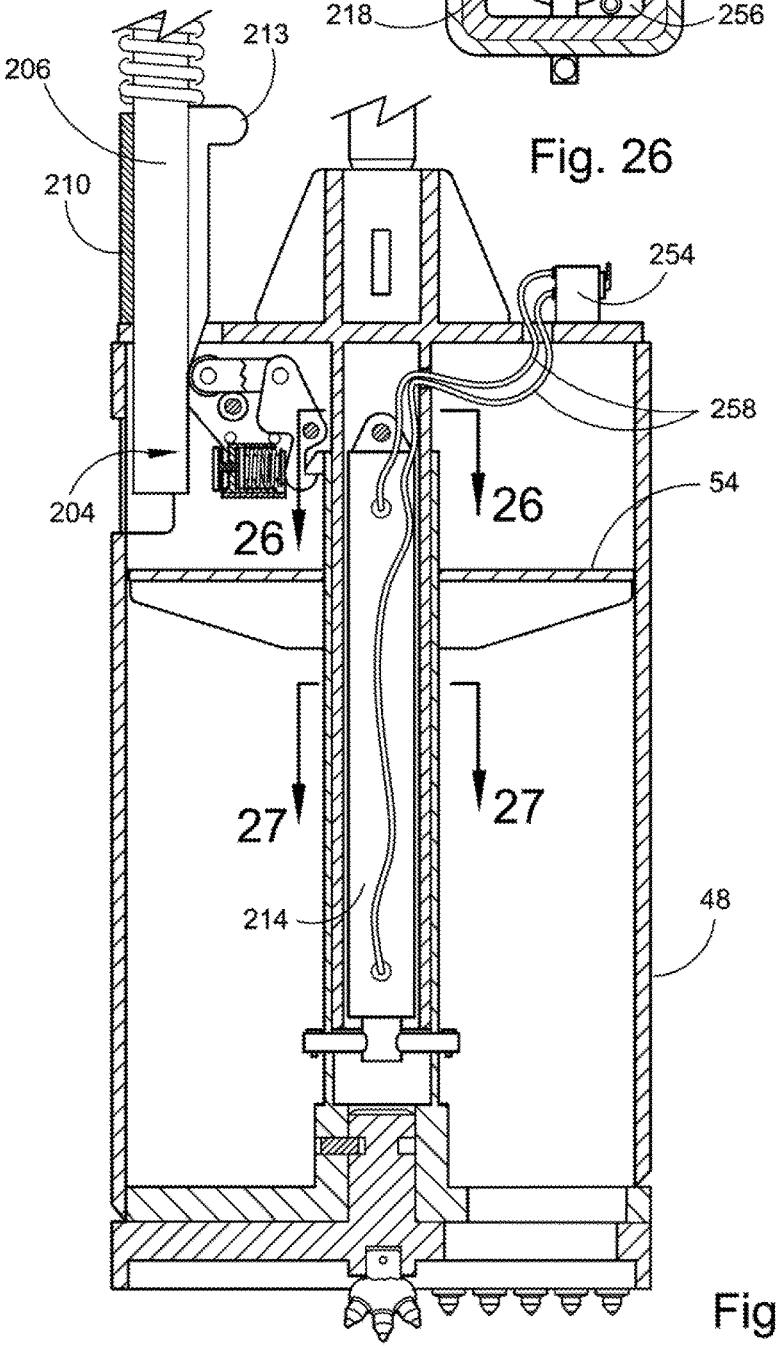
FIG. 25 depicts a cross section side view of the another embodiment of the Axially Separating Drill Bucket assembly having the spring loaded latching mechanism and the external flow control valve for a hydraulic cylinder.

FIG. 25 depicts a cross section side view of another embodiment of the Axially Separating Drill Bucket assembly 200 having the spring loaded latching mechanism 204. The flow within the hydraulic cylinder 214 is controlled through the hydraulic lines 258 to the manual hydraulic fluid flow control valve 254 attached to the exterior of the drill bucket 48 or remotely within the cab of the drill rig 14 will control the decent of the drill head 60.

Figure 26:
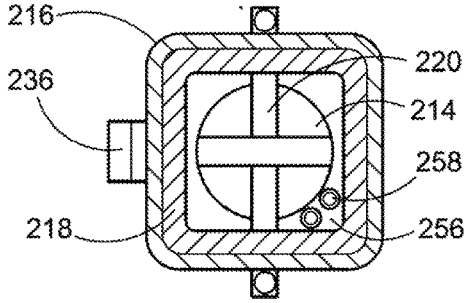
FIG. 26 depicts a cross section of the tipper and lower telescoping drill stems illustrating the location of the channel adjacent to the hydraulic cylinder for the hydraulic lines to the external flow control valve for the hydraulic cylinder.

FIG. 26 depicts a cross section of the inner tubular drill stem 218 and outer tubular telescoping drill stem 216 illustrating the location of the drill stem channel 256 adjacent to the hydraulic cylinder 214 for the hydraulic lines 258 to extend to the manual hydraulic fluid flow control valve 254 to release and control decent through the hydraulic cylinder 214 of the drill head 60.

Figure 27:
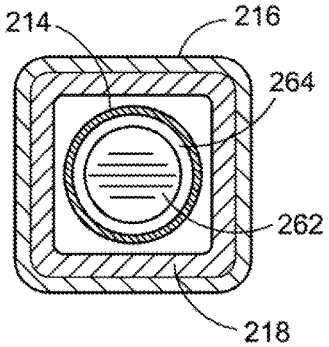
FIG. 27 depicts a cross section of the upper and lower telescoping drill stems and hydraulic cylinder illustrating reduced size piston allowing the restricted flow of the hydraulic fluid when the drill head is released.

FIG. 27 depicts a cross section of the inner tubular drill stem 218 and outer tubular telescoping drill stem 216 and hydraulic cylinder 214 illustrating the reduced diameter of the cylinder piston 262 allowing a restricted flow of the hydraulic fluid through the edge cavity 264 when the drill head 60 is released by the spring loaded latching mechanism 204 slowing and cushioning the decent of the drill head 60. With this system a sealed hydraulic cylinder 214 can be used effectively with no hoses. It is important to be noted that a full sized piston with an orifice or by-pass could also be used to control fluid flow internally without hoses.

Figure 28:
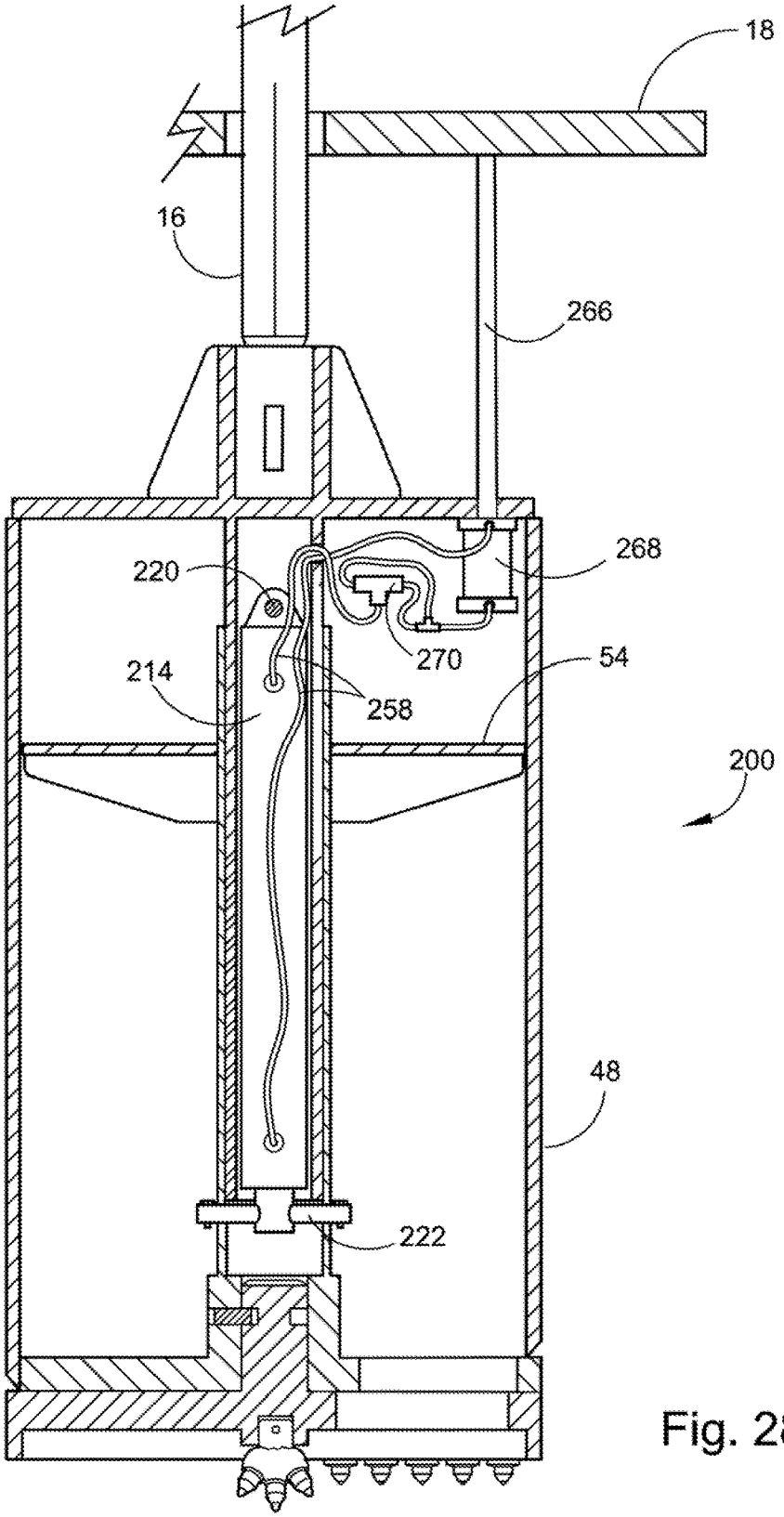
FIG. 28 depicts a cross section side view of another embodiment of the Axially Separating Drill Bucket assembly having the drill head released by the means of the sombrero pressing down on the activation rod of a second hydraulic cylinder to activate a pilot operated check valve to release and control descent of the drill head.

FIG. 28 depicts a cross section side view of another embodiment of the Axially Separating Drill Bucket assembly 200 having the drill head 60 released by the means of the sombrero 18 pressing down on the activation rod 266 of a second hydraulic cylinder 268 to open pilot operated check valve 270 to release and control decent of the drill head 60 through the hydraulic cylinder 214.

Figure 29:
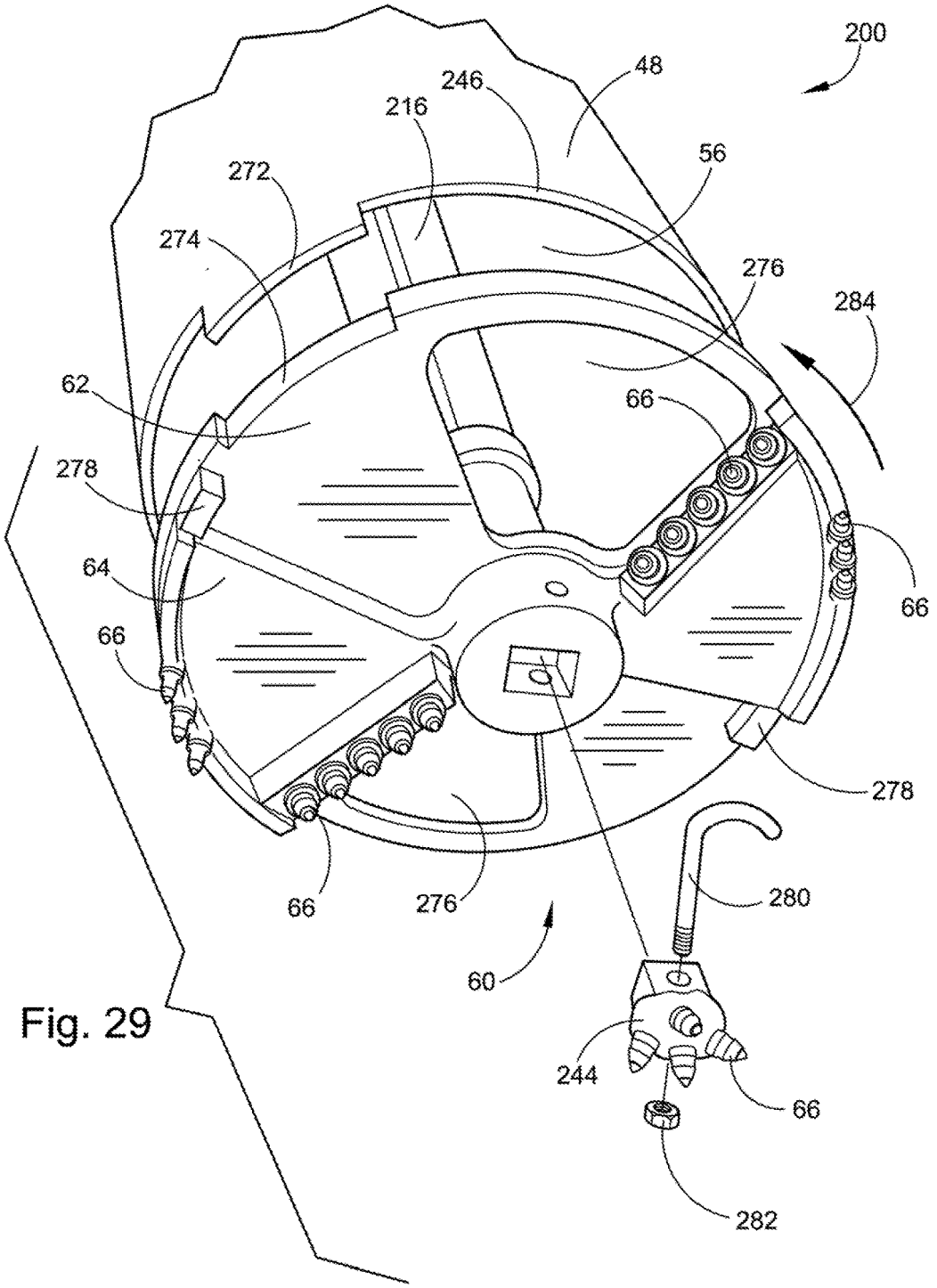
FIG. 29 depicts a Perspective view of the drill head end of the Axially Separating Drill Bucket assembly illustrating the interlocking system between the drill head and the drill bucket, the dual cavity opening into the drill bucket in the drill head plate and the bow tie shape of the drill tip plate with the centering tip exploded away.

FIG. 29 depicts a Perspective view of the drill head 60 end of the Axially Separating Drill Bucket assembly 200 illustrating the interlocking system between the drill head plate 62 and the drill bucket 48 where the segments 272 interlock with the cavities 274 in the drill head plate 62 to create a rigid structure. In this embodiment the drill head plate 62 has two orifices 276 into the central cavity 56 of the drill bucket 48. The drill tip plate 64 is constructed in a bow tie shape with the digging teeth 66 on either side. Digging teeth 66 can additionally be added around the perimeter of the drill tip plate 64. Two stop blocks 278 are welded on the drill head plate 62 to limit the rotation of the drill tip plate 64 to a point of opening or covering the two orifices 276 and trapping the material within the drill bucket central cavity 56. The replaceable centering tip 244 with digging teeth 66 is shown exploded away from the drill tip plate 64 where a locking pin 280 and nut 282 will secure it in place.

The unique feature of this application is when the Axially Separating Drill Bucket assembly 200 is rotating in a clockwise direction in the digging operation, indicated by the arrow 284, the drill tip plate 64 is held against the two stop blocks 278 opening the two orifices 276 into the drill bucket central cavity 56. After the digging the Axially separating drill bucket assembly 200 is rotating in the counter clockwise direction moving the drill tip plate 64 to closes off the two openings 276 to the drill bucket central cavity 56. To remove the material, the Axially separating drill bucket assembly 200 is raised up till the pushrod presses against the sombrero releasing the latch mechanism and the drill head 60 is lowered and rotated spreading the material out to the sides. When the drill bucket 60 is emptied it is lowered down away from the sombrero and pushed against the ground to automatically latch the assembly closed again. This operation can be completed by one person in the drill rig 14 with just the Axially separating drill bucket assembly 200.

The Axially Separating Drill Bucket 10, and the Axially Separating Drill Bucket assembly 200, shown in the drawings and described in detail herein disclose arrangements of elements of particular construction and configuration for illustrating preferred and alternate embodiments of structure and method of operation of the present application. It is to be understood, however, that elements of different construction and configuration and other arrangements thereof, other than those illustrated and described may be employed for providing an Axially Separating Drill Bucket 10, and the Axially Separating Drill. Bucket assembly 200, in accordance with the spirit of this disclosure, and such changes, alternations and modifications as would occur to those skilled in the art are considered to be within the scope of this design as broadly defined in the appended claims of this application.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

We claim:

1. An axially separating drill bucket assembly comprising:

a) a drill bucket drive section removably attached to a drill rig's Kelly bar having a sombrero attached thereto and wherein said Kelly bar is rotationally driven by a drill rig drive motor;

b) one or more drill stems including a fixed or removable drill head assembly;

c) a casing moveably attached to said one or more drill stems; and d) an activatable separation latch assembly further comprising a spring loaded latch, activatable by contact with said sombrero; and e) one or more hydraulic cylinders;

whereby when said activatable separation latch assembly comprising a spring loaded latch is activated by contact with said sombrero, said casing separates from said drill head assembly, wherein said separation is assisted through the actuation of said one or more hydraulic cylinders.

2. The axially separating drill bucket assembly according to claim 1, wherein said latch assembly further includes a push rod capable of making contact with said sombrero, and further wherein said push rod moves upwardly and downwardly making contact with said spring loaded latch.

3. The axially separating drill bucket assembly according to claim 2, wherein said push rod includes a tubular guide within which it translates upwardly and downwardly, an externally located and a tapered wedge shaped side portion which includes an upper guide stop section and a lower tapered section wherein said tapered wedge shaped side portion makes contact with said spring loaded latch.

4. The axially separating drill bucket assembly according to claim 2, wherein said activatable separation latch assembly is activatable by said push rod and said tapered wedge shaped portion making contact with said sombrero as the drill bucket is lifted during operation and said sombrero makes contact with said push rod.

5. The axially separating drill bucket assembly according to claim 1, wherein said spring loaded latch includes one or more links and one or more cross pins, and further wherein said spring loaded latch is latched and unlatched through the upward and downward motion of said push rod.

6. The axially separating drill bucket assembly according to claim 1, wherein said one or more hydraulic cylinders are housed in a central location within said casing.

7. The axially separating drill bucket assembly according to claim 1, wherein said one or more drill stems include an outer drill stem and an inner drill stem, wherein said one or more hydraulic cylinders is housed within said outer drill stem and said inner tubular drill stem.

8. The axially separating drill bucket assembly according to claim 1, further, including hydraulic lines and a flow control valve, wherein said one or more hydraulic cylinders is in fluid communication with said flow control valve through said hydraulic lines, and is thereby controlled to actuate upwardly and downwardly.

9. The axially separating drill bucket assembly according to claim 1, including a manually operated check valve, water release ports, a bow-tie shaped drill head tip plate with replaceable digging teeth thereon, and a fixed or replaceable center digging tip with replaceable digging teeth thereon, wherein said drill head tip plate and said fixed or replaceable center digging tip are secured by a locking pin and a locking nut.

10. The axially separating drill bucket assembly according to claim 1, wherein a limit strap replaces said one or more hydraulic cylinders.

11. A method for making an axially separating drill bucket assembly comprising the steps of:

a) providing a drill bucket drive section removably attached to a drill rig's Kelly bar having a sombrero attached thereto and wherein said Kelly bar is rotationally driven by a drill rig drive motor;

b) providing one or more drill stems including a fixed or removable drill head assembly;

c) providing a casing moveably attached to said one or more drill stems; and d) providing an activatable separation latch assembly further comprising a spring loaded latch, activatable by contact with said sombrero; and e) providing one or more hydraulic cylinders;

whereby when said activatable separation latch assembly comprising a spring loaded latch is activated by contact with said sombrero, said casing separates from said drill head assembly, wherein said separation is assisted through the actuation of said one or more hydraulic cylinders.

12. The method of making an axially separating drill bucket assembly according to claim 11, wherein said latch assembly further includes a push rod capable of making contact with said sombrero, and further wherein said push rod moves upwardly and downwardly making contact with said spring loaded latch.

13. The method of making, an axially separating drill bucket assembly according to claim 12, wherein said push rod includes a tubular guide within which it translates upwardly and downwardly, an externally located and a tapered wedge shaped side portion which includes an upper guide stop section and a lower tapered section wherein said tapered wedge shaped portion makes contact with said spring loaded latch.

14. The method of making an axially separating drill bucket assembly according to claim 12, wherein said activatable separation latch assembly is activatable by said push rod and said tapered wedge shaped portion making contact with said stationary sombrero as the drill bucket is lifted during operation and said sombrero makes contact with said push rod.

15. The method of making an axially separating drill bucket assembly according to claim 11, wherein said spring loaded latch includes one or more links and one or more cross pins, and further wherein said spring loaded latch is latched and unlatched through the upward and downward motion of said push rod.

16. The method of making an axially separating drill bucket assembly, according to claim 11, wherein, said one or more hydraulic cylinders are housed within said casing.

17. The method of making an axially separating drill bucket assembly according to claim 11, wherein said one or more drill stems include an outer drill stem and an inner drill stem, wherein said one or more hydraulic cylinders is housed within said outer drill stem and said inner drill stem.

18. The method of making an axially separating drill bucket assembly according to claim 11, further including hydraulic lines and a flown control valve, wherein said one or more hydraulic cylinders is in fluid communication with said flow control valve through said hydraulic lines, and is thereby controlled to actuate upwardly and downwardly.

19. The method of making an axially separating drill bucket assembly according to claim 11, including a manually operated check valve, water release ports, a drill head tip plate with replaceable digging teeth thereon, and a fixed or replaceable center digging tip with replaceable digging teeth thereon, wherein said drill head tip plate and said fixed or replaceable center digging tip are secured by a locking pin and a locking nut.

20. The method of making an axially separating drill bucket assembly according to claim 11, wherein a limit strap replaces said one or more hydraulic cylinders.

* * * * *